US008677902B1

(12) United States Patent
Rock et al.

(10) Patent No.: US 8,677,902 B1
(45) Date of Patent: Mar. 25, 2014

(54) PRECISION WATER JET DISRUPTOR DELIVERY SYSTEM

(76) Inventors: Thomas Michael Rock, Los Alamos, NM (US); Laney Alan Smith, Los Alamos, NM (US)

( * ) Notice: Subject to any disclaimer, the term of this patent is extended or adjusted under 35 U.S.C. 154(b) by 48 days.

(21) Appl. No.: 13/434,886

(22) Filed: Mar. 30, 2012

Related U.S. Application Data

(60) Provisional application No. 61/469,155, filed on Mar. 30, 2011.

(51) Int. Cl.
*F42B 1/02* (2006.01)

(52) U.S. Cl.
USPC ..... 102/306; 86/50; 89/1.13

(58) Field of Classification Search
USPC ..... 102/305–310, 402, 403; 86/50; 89/1.13, 89/1.15
See application file for complete search history.

(56) References Cited

U.S. PATENT DOCUMENTS

| | | | | |
|---|---|---|---|---|
| 3,724,372 | A * | 4/1973 | Phillips | 102/364 |
| 4,426,726 | A | 1/1984 | Cheetham | |
| 4,955,939 | A | 9/1990 | Petrousky | |
| 4,957,027 | A * | 9/1990 | Cherry | 89/1.14 |
| 4,987,818 | A | 1/1991 | Alford | |
| 5,134,921 | A * | 8/1992 | Breed et al. | 86/50 |
| 5,136,920 | A * | 8/1992 | Breed et al. | 86/50 |
| 5,194,690 | A * | 3/1993 | Guthrie et al. | 102/440 |
| 5,210,368 | A * | 5/1993 | Heller et al. | 86/50 |
| 5,303,633 | A * | 4/1994 | Guthrie et al. | 89/8 |
| 5,936,184 | A | 8/1999 | Majerus | |
| 6,113,343 | A | 9/2000 | Goldenberg | |
| 6,269,725 | B1 * | 8/2001 | Cherry | 86/50 |
| 6,363,828 | B1 * | 4/2002 | Sherlock et al. | 89/1.13 |
| 6,408,731 | B1 * | 6/2002 | Elsener | 86/50 |
| 6,453,788 | B1 * | 9/2002 | Lebet et al. | 86/50 |
| 6,584,908 | B2 | 7/2003 | Alford | |
| 6,606,950 | B1 | 8/2003 | Putman | |
| 7,134,375 | B2 | 11/2006 | Fish, Jr. | |
| 7,299,735 | B2 * | 11/2007 | Alford | 89/1.13 |
| 2005/0081706 | A1 * | 4/2005 | Alford | 89/1.13 |

* cited by examiner

*Primary Examiner* — Jonathan C Weber
(74) *Attorney, Agent, or Firm* — James Creighton Wray

(57) ABSTRACT

A precision coaxial water jet disruption explosive device system that holds a blasting cap precisely to the surface of a cylindrically cut positioned plastic explosive that couples a detonation shock wave into water surrounding a hollow forming cavity. A pressure relief vent enables the water filled system to be assembled without deforming the thin walled hollow jet forming cavity, enabling forming repeatable supersonic jets on centerline axis. This system is positioned with two triangular pivot legs and aligned with two fan light beams or a line sight to define a projected jet route to deliver a water jet that can cut through over 1 inch of steel and disrupt target objects more than 9 feet away. This system is used to disable improvised explosive devices, and other dangerous objects, without detonating the targeted explosives and electronic devices such that the contents are destroyed without explosion sequences occurring.

22 Claims, 15 Drawing Sheets

101

1. UNSCREW LID, PULL OFF RED CAP AND TAKE OUT VENT SCREW AND BLASTING CAP GRIP.
2. SCREW THE BLASTING CAP GRIP INTO THE HOLE OF THE LID UNTIL IT BOTTOMS. DO NOT INSTALL VENT SCREW YET.
3. USING LID, STAMP 2 PLUGS OF C4 EXPLOSIVE FROM M112 BLOCK. PRESS C4 FIRMLY INTO CAVITY ELIMINATING ANY GAP BETWEEN C4 AND LID.
4. REPLACE RED CAP TO COVER EXPLOSIVE, ENSURE FULLY SEATED.
5. FILL THE CYLINDER WITH WATER AS FULL AS POSSIBLE.
6. SCREW THE LID ON, KEEPING VENT HOLE IN LID AT THE HIGHEST POINT TO RELEASE AIR AS THE LID IS SCREWED DOWN TIGHT.
7. INSTALL VENT SCREW INTO VENT HOLE. A SMALL AIR BUBBLE IS OK
8. REMOVE BLACK CONE COVER, AIM CLOSER AT TARGET.
9. INSTALL BLASTING CAP INTO BLASTING CAP GRIP, ENSURING CONTACT WITH EXPLOSIVE, AND TIGHTEN NUT. TAKE COVER AND DETONATE.

100

FIG. 10a

111

110

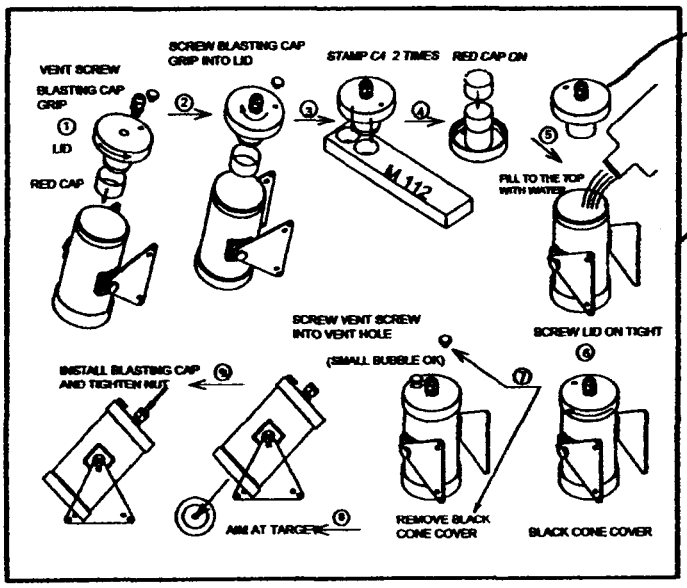

FIG. 10b

PRECISION WATER JET DISRUPTOR DELIVERY SYSTEM

This application claims the benefit of U.S. Provisional Application No. 61/469,155, filed Mar. 30, 2011, which is hereby incorporated by reference in its entirety as if fully set forth herein.

BACKGROUND OF THE INVENTION

Explosively formed water jet disruptors use high explosives, typically a shaped plastic explosive, to create a shock wave traveling through water or some other liquefying medium to collapse onto a forming cavity. This shock wave collapse by its geometry and the dynamic transit of the shock wave along the forming can create a supersonic jet of water that is ejected from the system. These supersonic water jets can be used to penetrate through walls such as mild steel plate that is over an inch thick. A very useful application, because the water jet it's non-sparking generating penetration, is to disrupt improvised explosive devices by severing the explosive sequence system and dispersing the improvised device explosives without detonating their explosives Prior art explosively driven water jet disruption systems have had a host of problems that have hampered demolition workers:

Blasting Cap Problems:
- Blasting caps not touching plastic explosive—leading to misfiring.
- Blasting cap penetrations that are too deep into plastic explosives can cause two shock waves and waste explosive energy, which poorly drive the explosion shock front coupling into the water jet.
- Off axis initiation due to a non-centered blasting cap leads to asymmetric and inaccurate water jets.
- Blasting caps come in multiple diameters and may not fit, or slip out of holders.
- Disarming by removing the blasting caps from plastic explosive and can leave a cavity in the plastic explosive. The subsequent rearming may require further pressing of the blasting cap into the plastic explosive, or result in non-contact. Non-contact can cause poor coupling of the blasting cap to the plastic explosive, resulting in asymmetric detonation, or non-initiation.

Shaping Plastic Explosive Problems:
- The cutting and shaping of a precise quantity of plastic explosive can be time consuming and not exact. Leading to uncertainty of the explosive drive and effect.
- The use of PETN to detonate the explosive has led to non-uniform burns since it is molded around the explosive by hand.

Water Filling Problems:
- Gravity filled and open ended devices are not flexible to position
- Displacement of water while assembling a sealed system can lead to pressurization of the water and deformation of the jet forming cavity.
- Bubbles or under filling of coupling water can lead to non-uniform shock coupling and imprecise jet forming.

Cone Positioning Problems:
- It has been observed that if the jet forming cavity cone in the coupling water touches the plastic explosive that there was poor shock coupling and the subsequent jet is malformed.
- It has been observed that if the jet forming cone in the coupling water was more than ¼ inch away from the plastic explosive the shock coupling was poor and the jet was malformed.

Cone Shaping Problems:
- Asymmetric cones have led to poor jet forming.
- If the thin wall cone is collapsed due to the water pressure the resulting shock jet can be miss formed and reduced power delivery and accuracy.
- Forming the jet forming cavity out of plastics and thicker walls, other than thin walled polyethylene produced weak jets.

Disruptor Positioning Problems:
- Alignment of the jet forming cone to intended target can be in accurate.
- Uneven surfaces near or on the intended targets can lead to poor positioning
- The alignment to a guide laser beam needs to be precise enough to align and use to 1.7 cm diameter water jet propelled over a 274 cm distance, (0.7 inch diameter water jet over 9 ft) (+−0.072 degrees).
- The target can be imaged with x-rays and a guide beam arranged to point at the precise component that needs to be disrupted to disable the target, thus the disruptor needs to have a mechanism to allow for alignment using the guide laser beam, gun sight, or telescope.

Remote Targeting Problems:
- Robots are expensive and can be destroyed by explosions
- The Robots can be source of metal shrapnel.
- Robots are needed in uncertain and dangerous disruption situations.

Heavy Metal Problems:
- Metal containers can lead to dangerous shrapnel and spark generation.
- Metal debris can interact with the environment and lead to more cleanup, while plastic debris can degrade and be environmentally inert.

Cutting and Shaping the Plastic Explosives Problems:
- The cutting and forming of the plastic explosive needs to be precise, to deliver a precise shock wave.
- Poor shaping or under or over fill has led to poor jet forming.

Clarity and Loss of Instructions Problems:
- Instructions need to be explicit and understandable
- Instructions need to be with the disruption device and not lost in the field.
- The instructions need to be destroyed with explosively driven water jet disruptor to avoid littering and perhaps informing adversaries.

Needs exist for an improved explosively driven water jet former and delivery system.

PRIOR ART

Alford U.S. Pat. No. 6,584,908 "Device for the Disruption of Explosive Objects" which issued Jul. 1, 2003, and was filed Jan. 26, 2001, is an example of an explosively driven liquid jet disruption device. This patent describes formed concave cavities (formers), that support explosive devices, and a liquid or gel, or material that liquefies filled bags, that when a detonation and explosion occurs, jets are formed by the concave cavities. Detonation cord and shock tubes are described to deliver shock waves. This patent does not describe using a precisely located blasting cap.

Alford U.S. Pat. No. 7,299,735 "Title" "Claim 6 projectile is one the following: a cone form, a flat disk, a radically symmetric body provided with a spherical, hyperbolic, other concavity, a wedge or V-shaped section." Alford has described the various shock wave shaping components or projectiles that can be placed in explosively driven water coupled disruptor. The invention provides the repeatable platform for these components to be interchangeably incorporated into the disruptor. This patent (Alford) does not describe a precisely located blasting cap, projectile, shaping cones, water venting port, sizing the explosive, locating the explosive, and laser alignment of the system to deliver a repeatable and precise disruption.

Petrousky U.S. Pat. No. 4,955,039 "Shaped Charge with Explosively Driven Liquid Follow Through" Petrousky describes a cylindrical explosively driven water jet disruption device. Explosives are placed at the end of the cylinder and around the body of a water filled cylinder. There is very little detail of how and exactly where the detonations are initiated. Petrousky describes the detonation using the forming cone, which forms a jet with the supersonic shock wave and the cone material covering the interior of the penetrated wall hole.

Alford U.S. Pat. No. 4,987,818 "Shaping Apparatus for an Explosive Charge." Alford describes a frictional blasting cap sleeve holder that is coaxial with the body and uses longitudinal expanding ribs on the internal surface:

"Said detonator supporting means may be adapted to support a tubular detonator so that the detonator extends substantially coaxially of the body from adjacent the apex of said partition. For example, said detonator supporting means may comprise a sleeve or passage coaxial with the body into which a said detonator can be inserted. The said sleeve or passage may have longitudinally extending ribs on the internal surface thereof for frictionally engaging a said detonator inserted therein. The detonator supporting means may be supported within said body by radially-extending spider members and such spider members may be in the form of web portions which also provide support for said partition. The detonator supporting means and said spider members may be integral with said body and said partition.

The said partition may have ribs or other projections on the internal conical surface thereof to provide a key for plastic explosive pressed against said surface and shaped thereby."

Alford does not describe a step sleeve to center the tubular blasting cap co-axially, or a screwed cap to clamp on the spider members, nor a water tight seal on the blasting cap. Alford does not describe using a step sleeve to position the explosive at the entrance of the sleeve.

Alford describes conical cutters and volumetric measure of the explosives. He describes water tight cap over explosive. He also mentions flyer plates placed on the explosive:

"Referring now to FIG. 3, it will be seen that an explosive charge utilizing the shaping apparatus of FIGS. 1 and 2 comprises a charge of plastic explosive inserted into the body 1 through the open end 4 thereof, a detonator 6 inserted into the sleeve 5 and a leg support 1 inserted into one of the tubular portions 9. The open end 4 of the tubular body 1 is closed by a closure member 15 which may be sealed by means of an O-ring seal or by applying a suitable sealing material, such as a silicon rubber sealing mastic, there around. If desired a disc or flyer plate 16, e.g. of copper or other metal or of plastics or other material may be inserted in the body 1 after the plastic explosive 3 has been inserted therein and before the closure member 15 is applied."

Alford describes a leg supports that can be bent to position the disruption system, as well as legs that can incorporate magnetic clamps:

"The apparatus may have connecting means whereby at least one leg or other support can be connected thereto. Such means may comprise, for example, at least one tubular portion into which one end of a wire leg can be inserted. Said at least one tubular portion may be on said other side of said partition and may extend longitudinally of said body adjacent the internal surface thereof. According to a preferred embodiment a said tubular portion is formed integrally with each of said web portions forming said spider members. The or each said leg may be formed from aluminum or other malleable wire which can be manually bent to position the shaping apparatus as required. The or each said leg may incorporate magnetic means whereby the shaping apparatus can be attached to a suitable surface, e.g. to the surface of a ferrous target."

Alford does not mention bubble removal and water venting. He does not mention laser guidance, precision non-touching placement of forming cone to the explosives and robot delivery.

Alford U.S. Pat. No. 7,299,735 "Device for the Disruption of the Explosive Ordinance" Alford describes using a range of tube sizes, projectiles of Mg, Zr, and Ti. Alford describes collimation of projectiles and bubble in the explosives causing problems. He describes different fluid.

Putman U.S. Pat. No. 6,606,950 "Method and Apparatus of Positioning a Shaped Charge" describes wire legs and pins that can be used to position shaped charges. Putnam also describes cylindrical blasting cap holders that can hold blasting caps with molded rubber friction component and can accommodate a range in sized of blasting caps. He does describe several examples of the need to position and align the explosive to the targeted objects. Putman does not mention triangular legs or tightening screws. He does not mention laser or gun scope or telescopic optical alignment means, or reflections off the explosive being positioned.

Fish U.S. Pat. No. 7,134,375 "Visual Assistance Guide System" Fish describes a checkerboard pattern that guides the alignment of the detonation system. Fish does not describe a laser guided system.

Majerus U.S. Pat. No. 5,936,184 "Devices and Methods of Clearance of Mines or Ordinance" describes a charge holding device that could be offset from the mine and had an adjustable orientation capability for the penetrating jet would be desirable as it is often hazardous to work or place a charge directly over a mine due to sensitive triggering devices such as pressure plates and trip wires. In certain embodiments, the apparatus for neutralizing an explosive device further comprises an orienting or positioning assembly to operably orient or position the apparatus in relation to the explosive device. In certain aspects, the positioning assembly is a stand or base standoff attached to the first portion. The arrangements for the base standoff contemplated for use include, but are not limited to: two or more legs, each leg extending substantially the length of one edge of the apparatus, the legs extending essentially perpendicular to the base of the apparatus; four legs proximal to the four corners of the base of the apparatus, the legs extending essentially perpendicular to the base of the apparatus; three legs, two legs proximal to two adjacent corners and the third leg proximal to the midpoint of the edge opposite the other two legs, the legs extending out at an angle away from the apparatus; and four legs proximal to the four corners of the base of the apparatus, the legs extending out at an angle away from the apparatus. In other embodiments, the positioning assembly comprises a stake and cross-member attached to the second portion. In yet other aspects, the positioning assembly comprises a cantilevered arm. Also included is a probe that snaps in place and elements for use with a means of strapping the apparatus to objects such as trees.

In certain aspects of the present invention, a standoff, or separation, between the apparatus and the explosive device or overburden is preferred. Standoff distances from between about 0.5 inches and about 12 inches to 24 inches are contemplated, as well as intermediate standoff distances, such as about 1 inch, about 2 inches, about 2.5 inches, about 3 inches, about 4 inches, about 5 inches, about 6 inches, about 7 inches, about 8 inches, about 9 inches, about 10 inches, about 11 inches, about 15 inches, about 18 inches, about 20 inches or about 22 inches or so.

Cheetham et al. U.S. Pat. No. 4,426,726 uses fan beams to define where x-ray beams will strike patients in medical imaging. The use with explosives devices is not mentioned.

Goldenberg et al. U.S. Pat. No. 6,113,343 describes robots working in hazardous conditions and with disruption devices and describes using a single laser and video cameras to image the aiming of the systems but does not describe using fan beam lasers to aim disruption devices.

SUMMARY OF THE INVENTION

The new invention provides the following new components to form the precision explosively driven water jet former and delivery system:

a blasting cap sleeve with cone ledge, a clamping ferrule with slit fingers and rubber ring, a blasting cap holder flush mounted to interior surface of lid, a water vent hole and screw plug, a lid with an O-ring that holds the blasting cap clamping ferrule and with a die-cup to cut and hold plastic explosive, and the lid having a threaded connection to an outer cylinder, plastic explosive cut and loaded into the die-cup, water, other liquids or materials that liquefy when shocked, filled in a space defined by the outer cylinder, the lid and die cup, an inner cavity former and the water vent screw plug, an explosive cover cap, disk inserts into the cover cap, interchangeable cavity formers and shapes and materials, such as diverging and converging cones and blade cones with lips that fit to an end of the outer cylinder with an O-ring seal, cavity formers that can be attached and sealed onto the explosive cutter holder for flyer plate configurations with a converging cone instead of a diverging cone, objects can be placed inside the cavity cones such as metal plated and metal beads or rods, end cap cover, two pivot mounts on the outer cylinder with knurled adjustment screws, an end cap that can have insert disks, precision coaxial and on-axis distance positioning of the cone to plastic explosive within the outer cylindrical body providing a 1/16 inch-1/32+1/16 inch gap between tip of a cone and a plastic explosive cover, triangular leg stands that mount on pivots with screws securing the leg stands onto the cylinder, a laser alignment jig that defines a centerline aiming line with the intersection of two fan beams of laser light perpendicular to the outer cylinder, a surrogate blasting cap cylinder and alignment mirror that fits the blasting cap sleeve, a remote expendable delivery vehicle, instructions on the side of the outer cylinder with words and pictures, correct assembly feedback marks, and all plastic assembly or ceramic.

The new invention leads to solving the previously described host of problems of explosively driven water jet disruptors. The invention solves these problems with the following embodiments and features of The invention.

Precision Blasting Cap Placement:

Ideally the blasting cap should just touch the plastic explosive to initiate the detonation shock wave.

The blasting cap needs to be firmly secured to the surface of the plastic explosive.

The attachment of the blasting cap needs to be a rapid and simple operation to secure the disruptor and plastic explosive.

The blasting cap can be easily and repeatedly removed and re-attached if the disruptor needs to be disarmed or rearmed.

Multiple sizes of blasting caps can be utilized.

The invention provides a precise plastic sleeve with a bottom cone ledge to accept the range of blasting cap barrels. A cone ledge centers the tip of the blasting cap when inserted, and positions the blasting cap adjacent to the surface of the plastic explosive. The outer end of the blasting cap holder has a clamping ferrule and rubber ring that can clamp onto to a range of diameters of blasting caps. The blasting cap holder is screwed into the lid of the cylindrical assembly and is positioned on the center of where the plastic explosive surface will be held.

The lid of the system contains the threaded entrance for the blasting cap holder and is machined to match the blasting cap holder such that the blasting cap holder forms a flush surface on the interior surface of the lid. On the underside of the lid is a die cutting cylinder cup, with a tapered cutting edge. The operator presses the lid, with the blasting cap holder in place, into a slab of plastic explosive and thereby cuts out a cylinder of plastic explosive and loads the plastic explosive into the die cup on the lid of the system. The plastic explosive fills the die cutting cylinder cup with a precise amount of explosive that presses up into the blasting cap holder. A plastic cover is placed over the die cup and the plastic explosive.

Recent tests shows 34 out of 34 firings were successful. Plastic bushings were installed into the water-resistant cable clamp. The clamps are able to hold two different standard military size blasting caps at a precise distance from the explosive.

Precise Shaping and Holding of Plastic Explosives:

The invention forms the lid of the system as a die cutting cup that enables the worker to cut and fill the lid of the system with a precise amount of plastic explosive and pack it tightly against the blasting cap holder.

Precise Water Filling Feature and Embodiment:

The invention has a water chamber surrounding the shock forming cavity, and the lid is provided with a vent hole. The lid and the die cup with the loaded plastic explosive will displace water in the filled chamber, and the excess water can escape through the vent hole. The water vent hole is sealed with a knurled screw. The venting permits the cavity to be fully filled with water, to remove bubbles, and not to pressurize the water.

Precise Cone Positioning Embodiment

The invention builds the lid and shock shaping cone to be held with a precisely machined cylinder. The lid and the cone sit on the ends of the cylinder. All the components are aligned on axis and are precisely spaced apart. The plastic explosive in the lid die cup can be trimmed with a blade to insure that it is flush with the rim of the lid die cup.

Adaptable Cone Shaping Feature:

The invention builds the shock forming cones as precise cones that mate to the end of the holder cylinder. The cones are molded or machined out of a variety of plastics or other materials. Our current experience has shown that molded thin walled polyethylene cones work well. Solid lithography production has been used to create a variety of shapes such as inverted cones (open at explosive end and narrow at output end), fin-like cones (broad in one dimension and narrow in the other dimension). An important feature is to be able to replicate the cones shapes and precisely locate the cones with respect to the explosives and surrounding water to create repeatable supersonic jet characteristics. The repeatable jet characteristics can be used to match how the water jet disruption is to be used. Examples are to use a symmetric plastic cone to deliver a non-sparking water jet into a container in close proximity round-hole penetration.

A blade-like cone delivers a slicing water jet,

A copper-metal-plated-plastic-cone forms a jet with higher specific energy density and penetration into dense materials.

A converging cone transforms a metal insert driven by the shock wave to intensify and focus the energy of the disk inserts for enhanced penetration.

A cone is made of a material that has certain chemical or mechanical properties, such as Teflon that lubricates or a material that can chemically react.

Precise Alignment Embodiment:

The invention creates a laser alignment scheme that will provide a positive visible alignment of the disruptor to the target such that the location of the formed jet is assured. The lasers create two fan beam line illuminations that cross where the jet will strike. This enables a non-contact alignment to the target. The lasers are held precisely to the cylindrical body of the disruptor and the crossing point defines a projected centerline of the cylinder. This alignment is feasible because the blasting caps, plastic explosives and shock forming cavities, water, and outer cylinder are all coaxial and the resulting supersonic jet ejects on their centerline. The invention has two triangular feet. Screw pivots allow the feet to rotate and clamp. The triangular feet have multiple holes that allow multiple spacing distances of the disruptor from the intended target surface. The triangular feet can be rotated to adjust to irregular surfaces. The axis of the pivot screws may intersect the centerline of the outer cylinder to make the alignment adjustments orthogonal.

The two fan beam lasers could be pointed back toward the blasting cap end of the disruptor and define the centerline. The lasers can mark a crossing beam on the front of a guide laser or alignment telescope when in alignment.

The invention provides a surrogate blasting cap with a mirror end surface that is perpendicular to and on the axis of the disruptor. This surrogate blasting cap can be inserted into the blasting cap holder to shape the plastic explosive without using a viable blasting cap. The surrogate blasting cap with the mirror can provide a precise alignment for laser and optical alignments of the disruptor because the disruptor system is formed as a precise coaxial system. In operation an alignment beam laser can be defined by viewing the improvised explosive device, such as with x-ray imaging, and laser beam, gun sight, or a telescopic alignment to the target is positioned. The disruptor can then be positioned until the alignment laser reflects from the center of the surrogate blasting cap mirror and the front of the alignment laser. If an alignment telescope or gun scope is used, then a reflected image back to the telescope will define the disruptor's centerline as being coincident.

Adaptable Robot Embodiment:

In many dangerous and under certain situations a robot may be used to deliver and position the disruptor. Ideally the robot may be used repetitively and with only the probe arm being destroyed. However, often the explosions of disruptors tend to damage and destroy robots. The invention couples a low cost robot with the explosively driven water jet disruptor to create a compact, lightweight, and low shrapnel producing system. The low cost robots have small amounts of metal parts, batteries, and plastic exteriors, which lead to a low production of shrapnel.

Enables Metal Disruptor Embodiment:

The invention provides an all plastic system that minimizes the creation of dense metal shrapnel. We can incorporate metals in the supersonic jet, but only just sufficient to provide the particular jet properties. Metal components such as the robot and laser alignment system may incorporate metal objects, but these can be minimized.

Precise Cutting and Shaping of Plastic Explosives Embodiment:

The invention creates a cutting die in the lid of the assembly that allows the user to press-cut the plastic explosive and fill the cutting die. The plastic explosives within the die are pressed up against the blasting cap holder where the blasting cap will make detonation initiation. The plastic explosive does not extrude through the small hole with the typical pressure exerted by a human worker. The cutting die cup forms a convenient and precise means of measuring the plastic explosive and simultaneously loading the disruptor.

Clear and No-Loss Instructions Feature:

The basic instructions to operate explosively driven water jet disruptor are laminated with a semitransparent membrane glued to the side of the cylinder. These instructions show the steps needed to assemble explosively driven water jet disruptor and the general means of positioning the device with respect to the target. The problem of having instructions separated from the device is avoided by placing the instructions on the device itself. The semi-transparent instructions allow the user to see inside the disruptor and verify water levels, and alignment of the components. When viewed from the outside of the transparent cylinder, marks on the instructions indicate the assembly is correct and alignment has been achieved. By having the instructions printed on a thin membrane on the side wall of the disruptor, the instructions will be destroyed when the disruptor is fired. This eliminates potential litter while denying adversaries potential information that could be used to understand how the disruption was accomplished.

None of the prior art references describe a precise positioning of the tip of the cone cavity cone to be separated from the surface with water of the contained high explosives by +1/16 of an inch and no less than 1/8 of an inch. None of the references mention venting of gas or water from explosively driven water jet disruption devices to remove bubbles. None mention laser or optical telescope or gun sign alignment, or reflections off the water jet disruption devices. None mention surrogate blasting cap cylinders to shape the plastic explosives and do optical alignment. None mention affixing instructions to the water jet disruption devices.

These and further and other objects and features of the invention are apparent in the disclosure, which includes the above and ongoing written specification, with the claims and the drawings.

BRIEF DESCRIPTION OF THE DRAWINGS

The following lists are a brief description of embodiment drawings and their components with their corresponding descriptions and identifying numbers.

Figure 1:
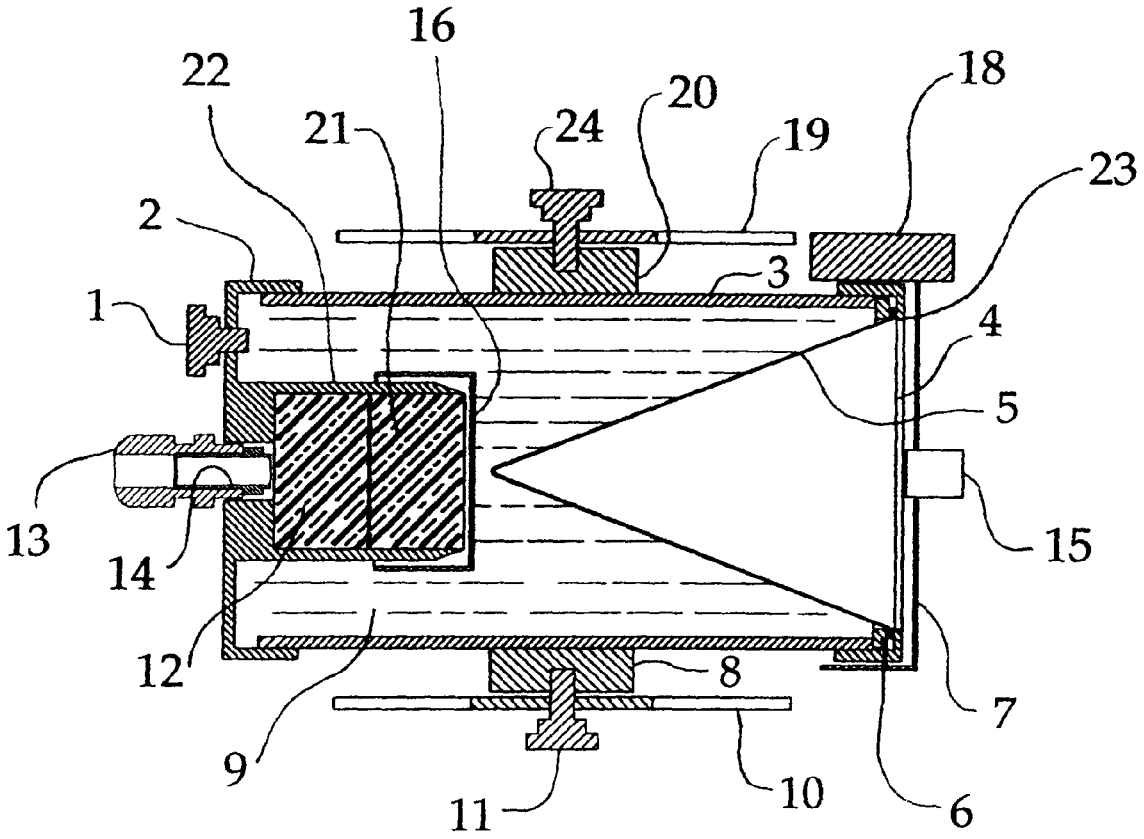
FIG. 1 is a cross-sectional view of the explosively driven water disruption device, including.

1. Vent screw
2. Explosive holding end cap
3. Exterior plastic cylinder
4. End ring
5. Forming cone
6. O-ring seal
7. Laser holding ring and cover cap

Figure 2:
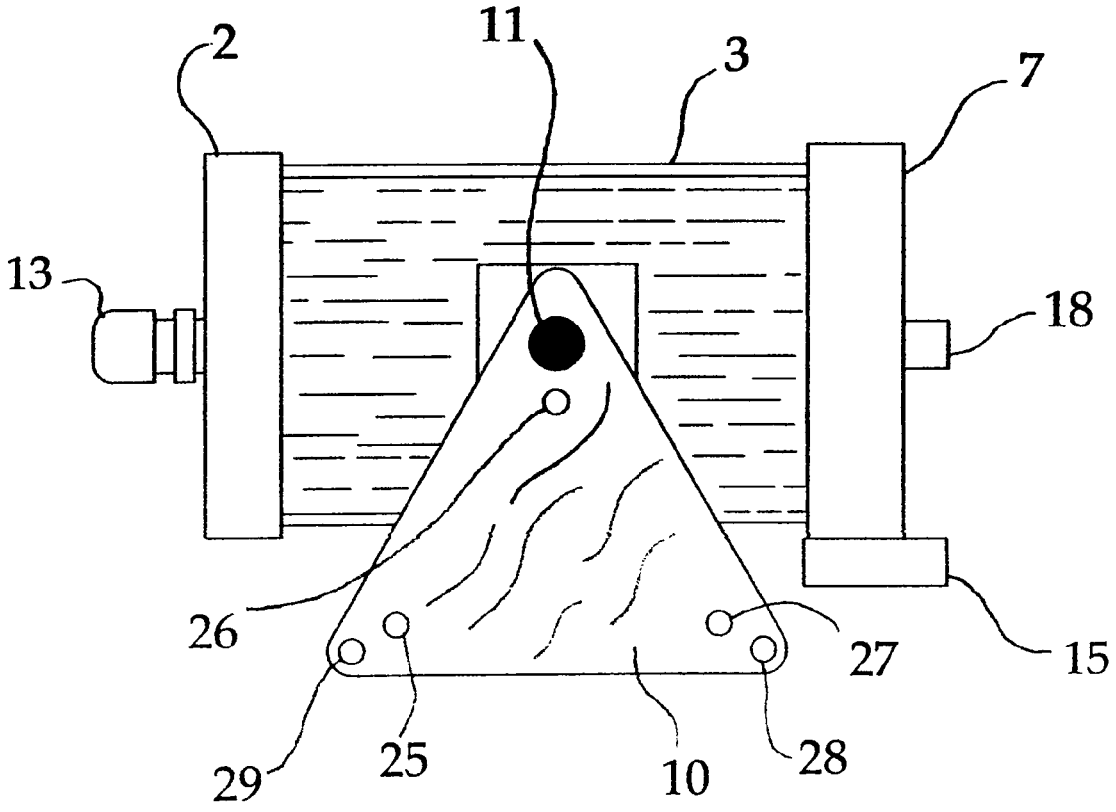
Figure 3:
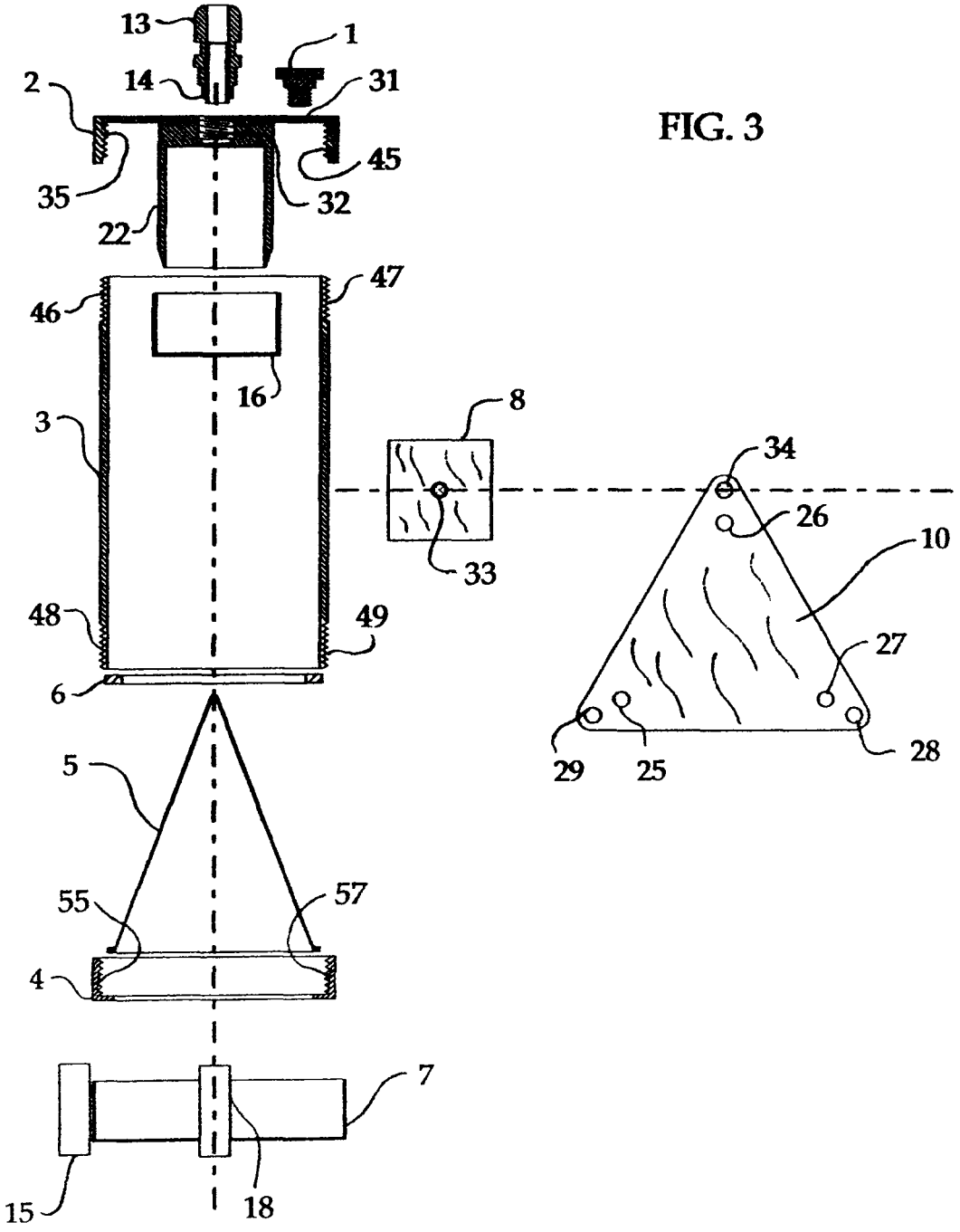
Figure 4A:
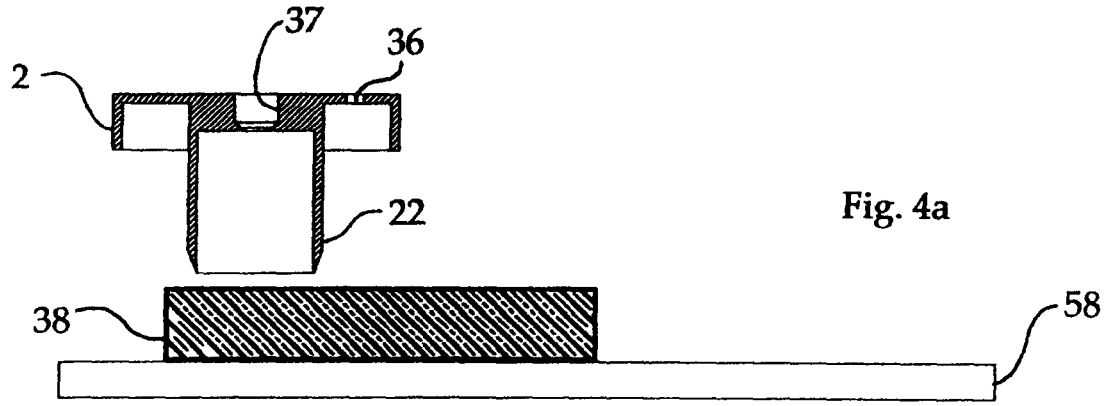
Figure 4B:
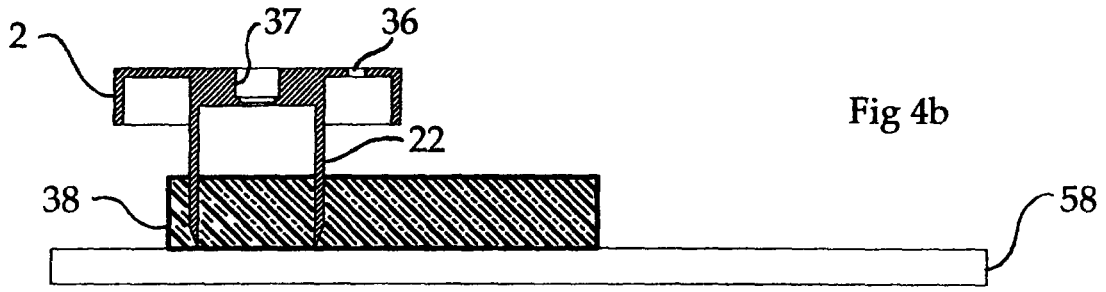

8. Pivot screw mount
9. Water
10. Triangular legs
11. Leg pivot screws
12. Plastic explosive
13. Blasting cap holder
14. Blasting cap liner sleeve
15. Fan beam alignment laser
16. Explosive cover cap
18. Second fan beam laser
19. Second triangular leg
20. Second pivot mount
21. Second disk of plastic explosive
22. Die cutting cylinder
23. Forming cone lip
24. Pivot Screw FIG. 2 is an exterior side view of the disruptor system showing the triangular legs and lasers attached, including:

25. Inner hole on triangular leg
26. Inner hole on triangular leg
27. Inner hole on triangular leg
28. Outer hole on triangular leg
29. Outer hole on triangular leg FIG. 3 is an exploded cross-sectional view of the disruptor system components, including:

31. Threaded vent hole
32. Threaded hole for the blasting cap holder
33. Threaded hole for pivot screw
34. Outer hole on triangular leg
35. Threaded inner cap
45. Thread on cap
46. Thread on cylinder
47. Thread on cylinder
48. Thread on cylinder
49. Thread on cylinder
55. Thread on ring
57. Thread on ring FIG. 4*a* is a cross-sectional view of the die cutting lid and the block of plastic explosive, including:

36. Vent hole
37. Hole for blasting cap holder
38. Plastic explosives block
58. Firm Flat surface FIG. 4*b* is a cross-sectional view of the die cutting lid cutting into the block of plastic explosive to load the first cylinder of plastic explosive.

Figure 4C:
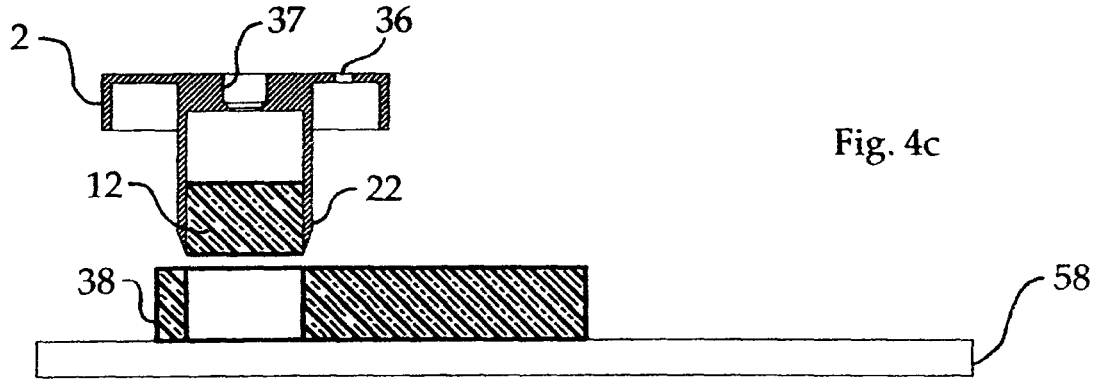

FIG. 4*c* is a cross-sectional view of the die cutting lid pulling out of the block of plastic explosive with a loaded cylinder of plastic explosive.

Figure 4D:
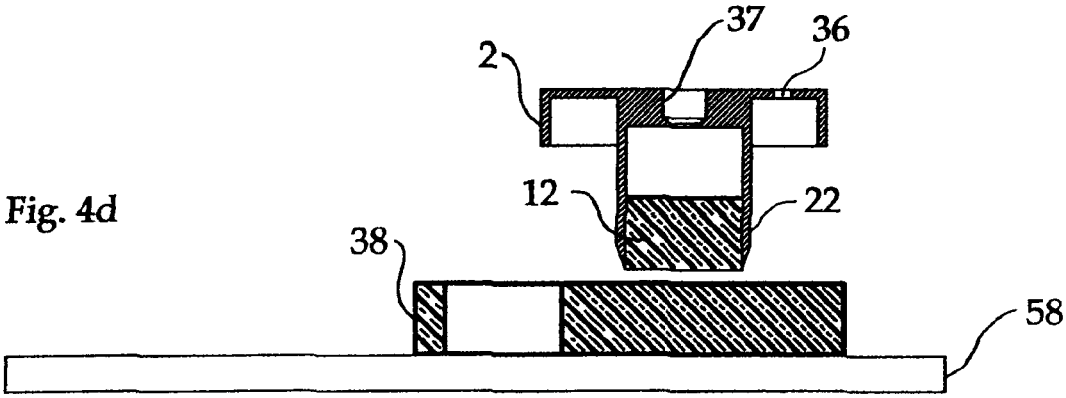
Figure 4E:
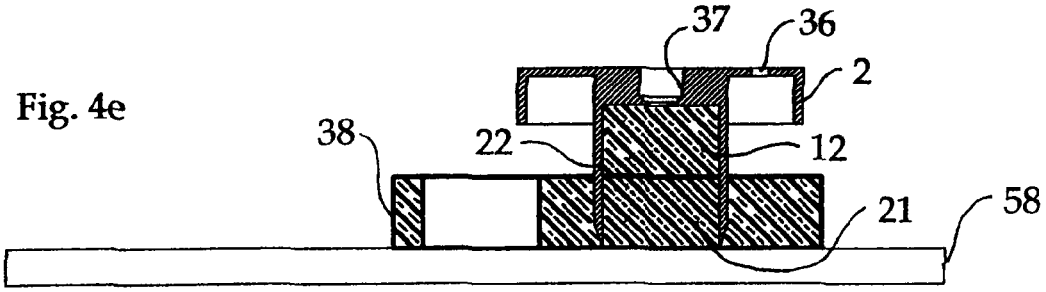

FIG. 4*d* is a cross-sectional view of the die cutting lid positioned over the block of plastic explosive to cut a second cylinder of plastic explosive FIG. 4*e* is a cross-sectional view of the die cutting lid being pressed into the block of plastic explosive.

Figure 4F:
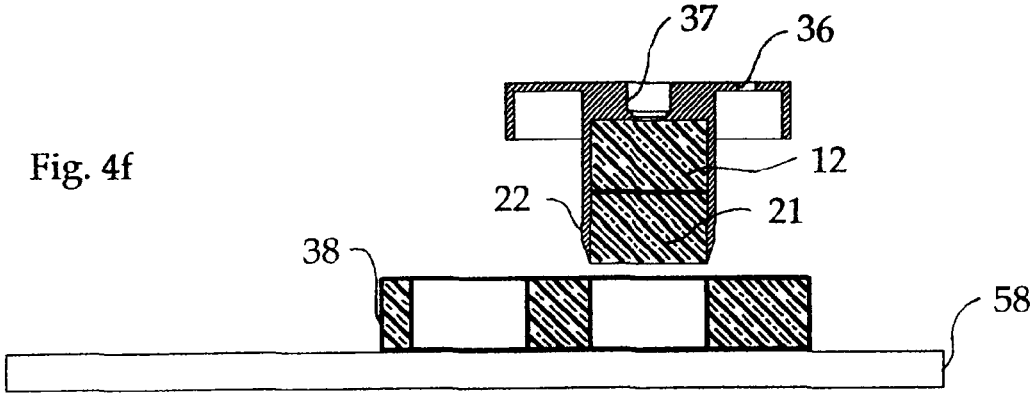

FIG. 4*f* is a cross-sectional view of the die cutting lid being removed from the block of plastic explosive loaded with two cylinders of plastic explosive.

Figure 4G:
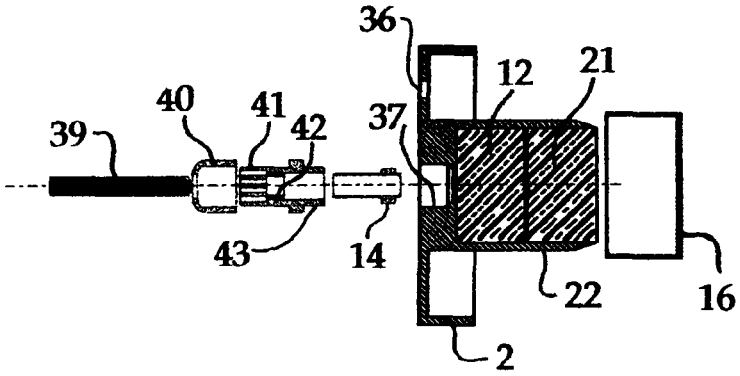

FIG. 4*g* is an exploded assembly cross-sectional view of the blasting cap assembly and the plastic explosive loaded lid.

Figure 4H:
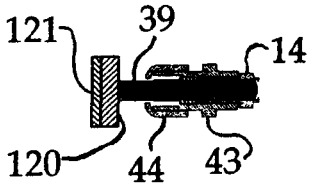

39. Blasting cap
40. Threaded cap
41. Clamping fingers
42. Rubber grommet ring
43. Threaded body
44. Assembled blasting cap in holder FIG. 4*h* is a cross-sectional view of surrogate blasting blasting cap in assembled holder.

Figure 4I:
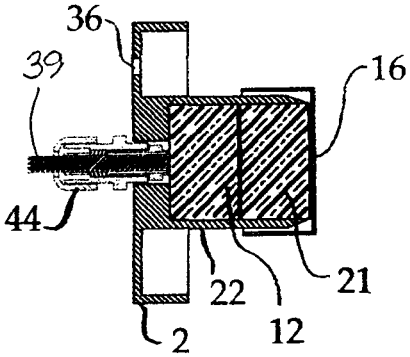

120. Blasting cap surrogate cylinder
121. Reflector on end of surrogate blasting cap surrogate FIG. 4*i* is a cross-sectional view of the assembled plastic explosives holding lid and the blasting cap holder.

Figure 5A:
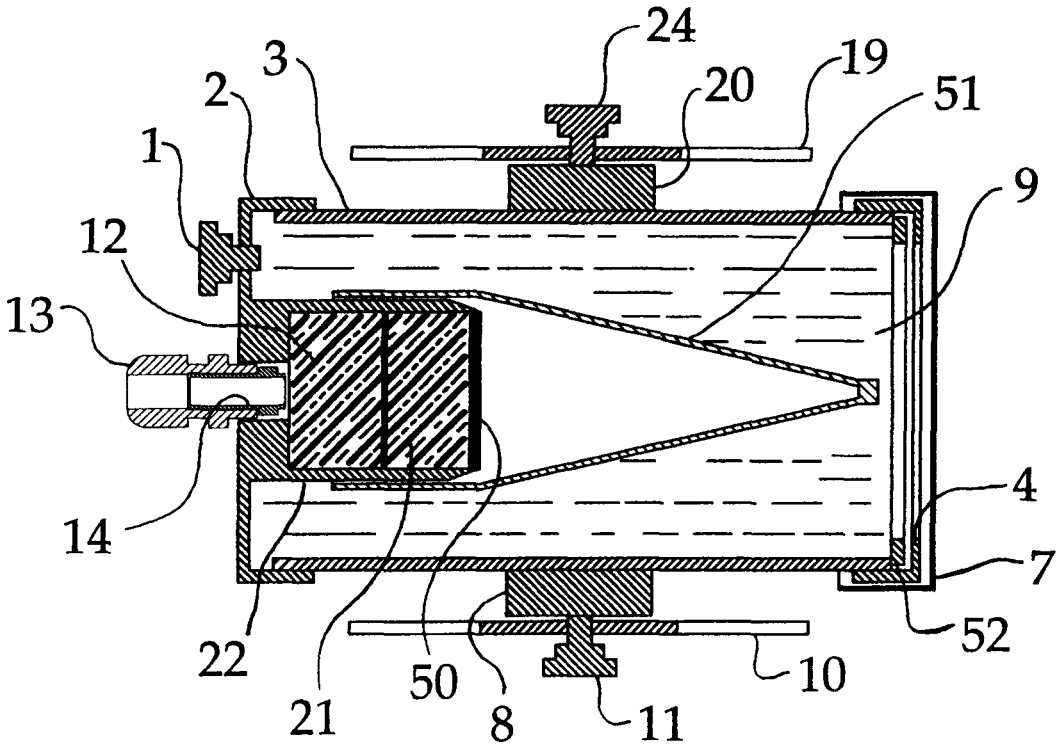

FIG. 5*a* is a cross-sectional view of the disruptor system with a flyer plate and convergent forming cone.

50. Flyer plate
51. Converging cone
52. Sealing ring

Figure 5B:
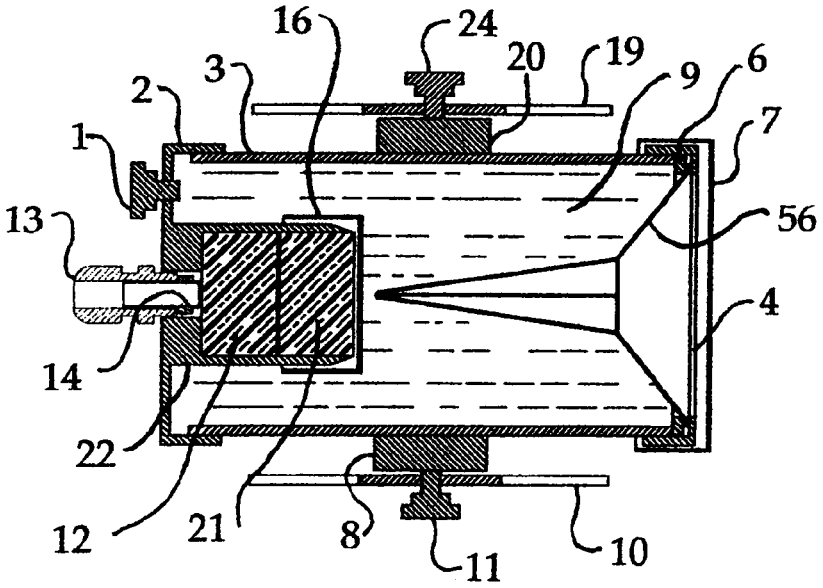

FIG. 5*b* is a cross-sectional view through the narrow section of the disruptor system with a fin-shaped forming cone.

56. Fin shaped cone

Figure 5C:
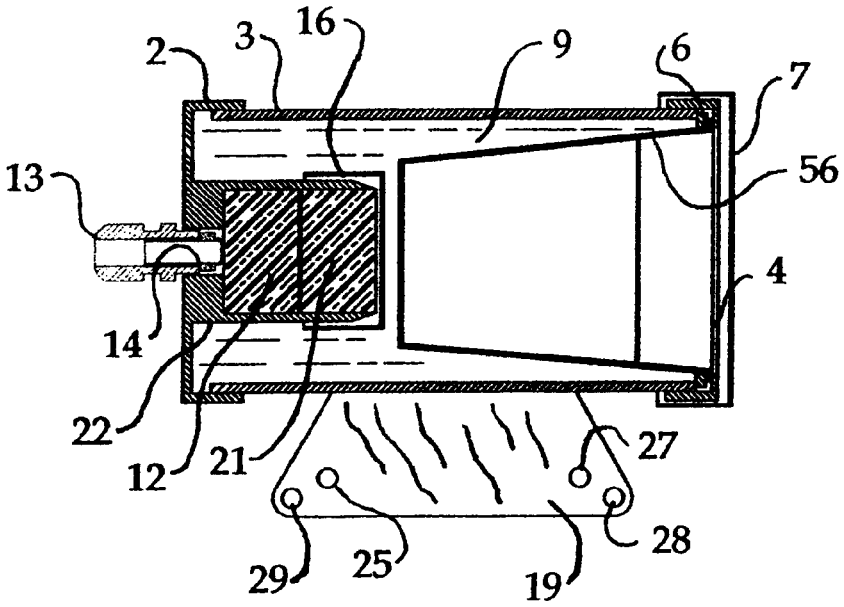

FIG. 5*c* is a cross-sectional view through the wide section of the disruptor system with a fin-shaped forming cone.

Figure 6A:
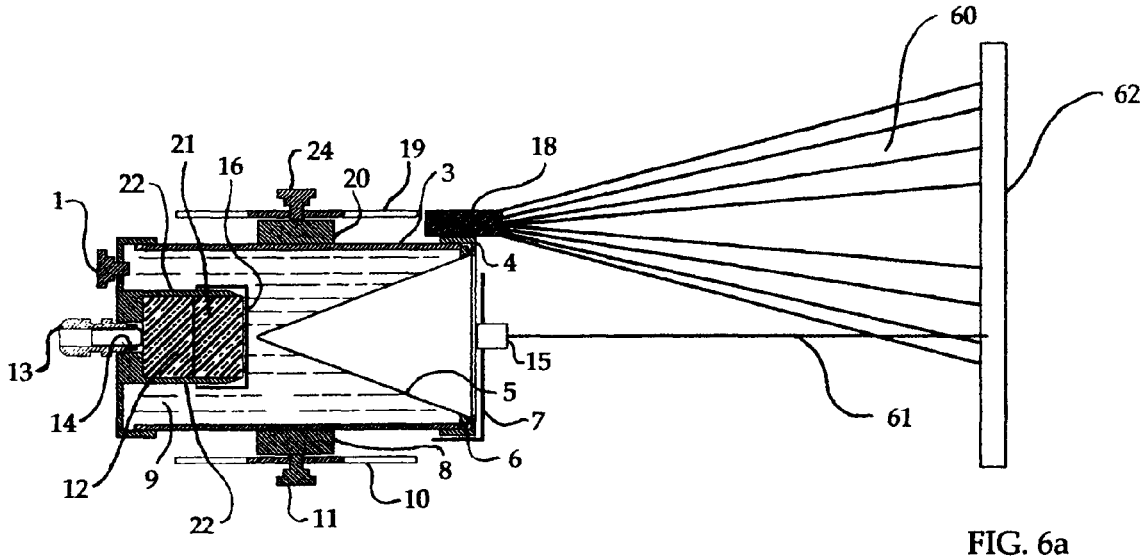

FIG. 6*a* is a top side cross-sectional view of the disruptor system with the position and fan beams of the laser alignment shown.

Figure 6B:
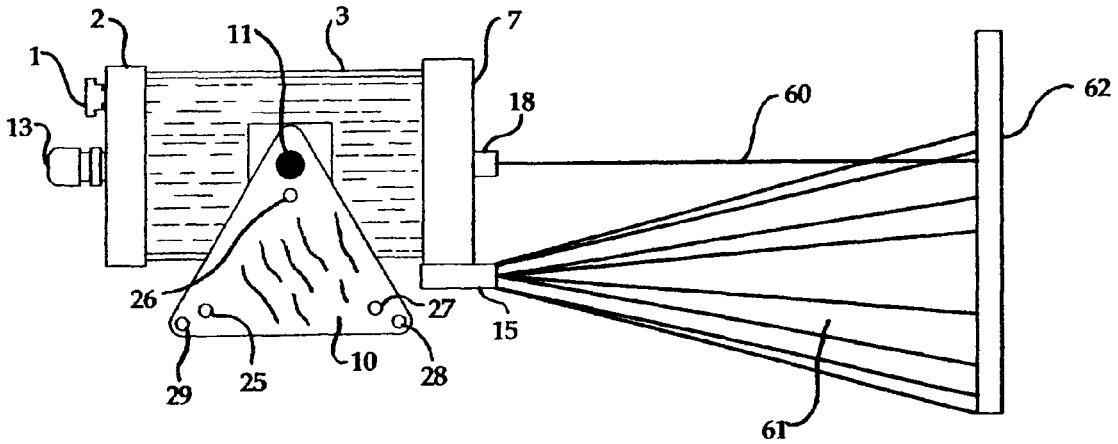

60. Laser fan light beam from first laser
61. Laser fan light beam from second laser
62. Target wall FIG. 6*b* is a side exterior view of the disruptor system showing the fan laser beams.

Figure 7A:
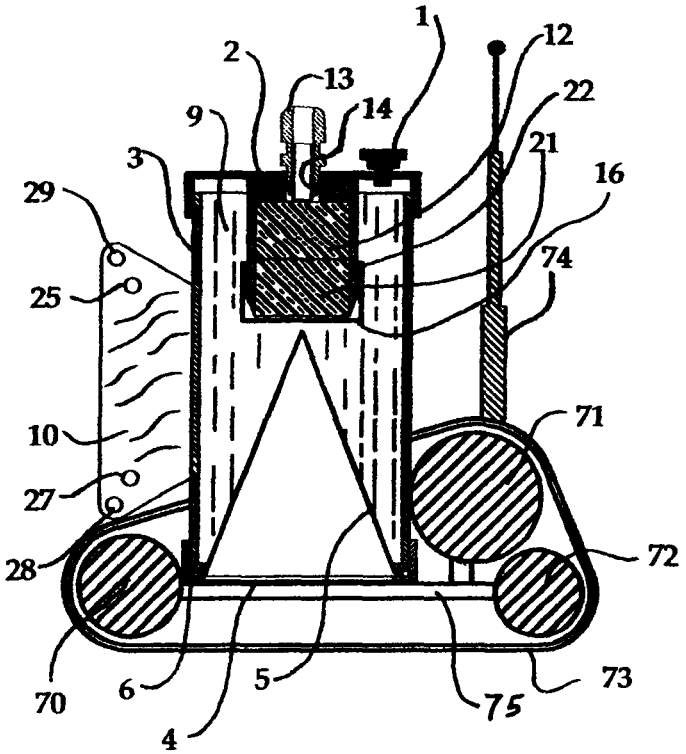

FIG. 7*a* is a robot vehicle positioning the disruptor.

Figure 7B:
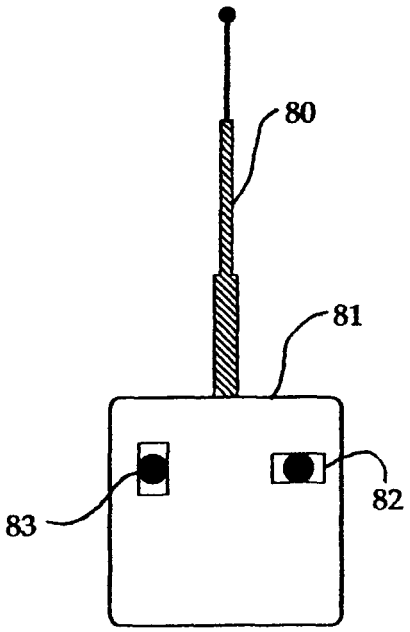

70. Wheel
71. Wheel and motor drive
72. Wheel
73. Tread belt
74. Radio control of motor drive antenna
75. Frame FIG. 7*b* show a radio control transmitter for robot vehicle.

Figure 8:
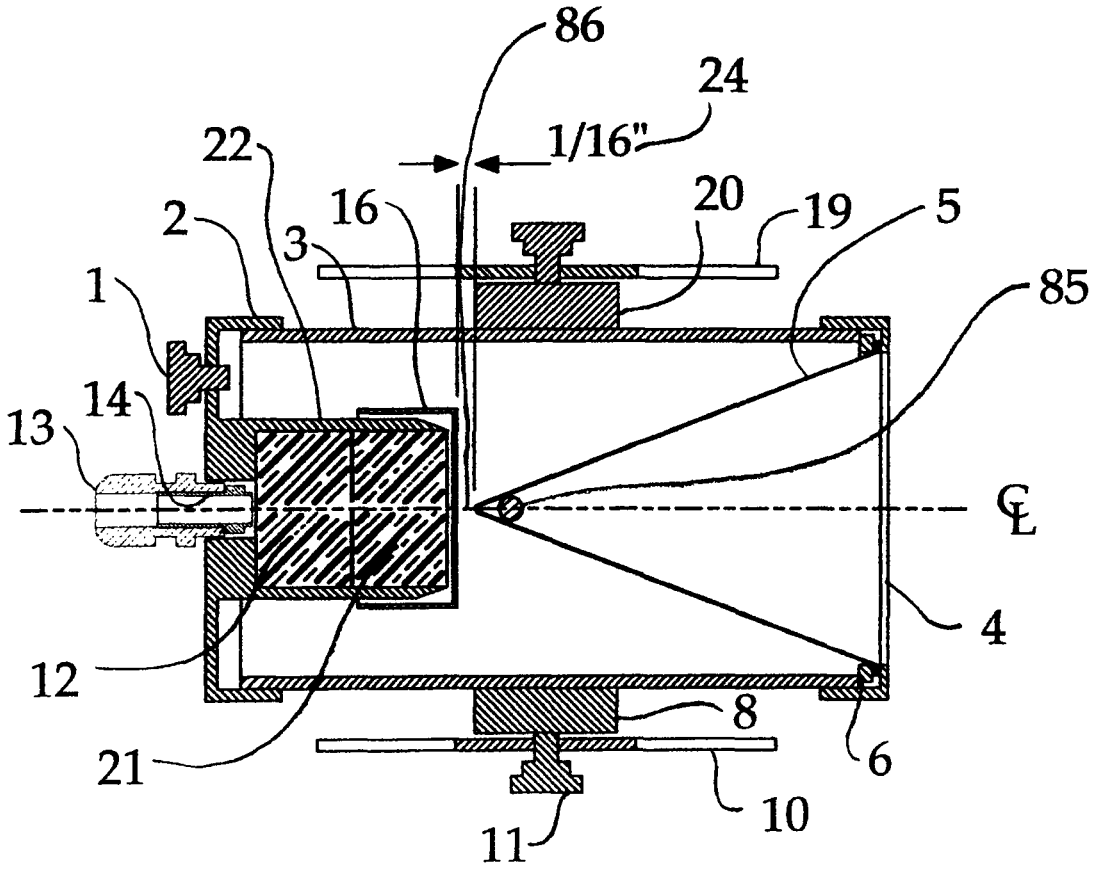

80. Antenna
81. Radio controller box
82. Clockwise and counter-clockwise toggle switch to command robot vehicle
83. Forward and reverse toggle switch to command robot vehicle FIG. 8 is a top side cross-sectional view of the disruptor system showing a possible bead projectile placement and the positioning gap between the forming cone and the cap on the plastic explosives.

Figure 9A:
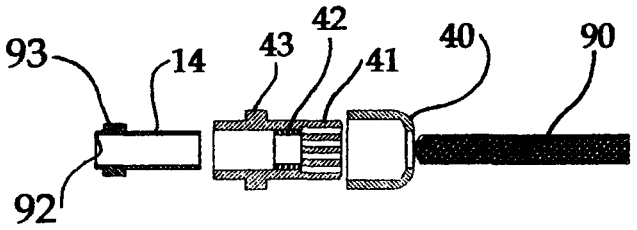

85. Small bead
86. 1/16 of an inch separation gap between plastic explosives cap and the tip of the cavity forming cone FIG. 9*a* is a cross-sectional exploded view of the large diameter blasting cap and clamp assembly.

Figure 9B:
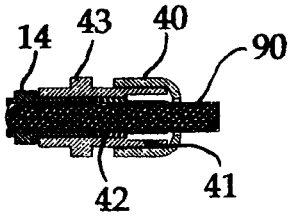

90. Large diameter blasting cap
92. Ledge on end of blasting cap sleeve
93. Shoulder of sleeve FIG. 9*b* is a cross-sectional view of the assembled large diameter blasting cap and clamp assembly.

Figure 9C:
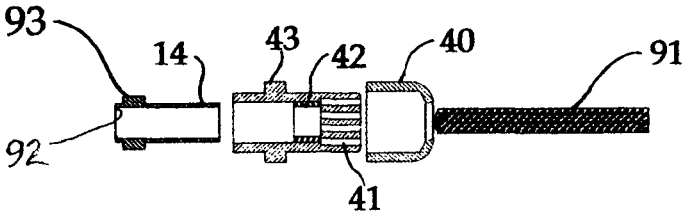

FIG. 9*c* is a cross-sectional exploded view of the small diameter blasting cap and clamp assembly.

91. Small diameter blasting cap

Figure 9D:
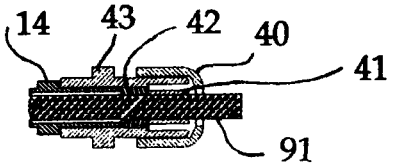

FIG. 9*d* is a cross-sectional view of the assembled small diameter blasting cap and clamp assembly.

Figure 9E:
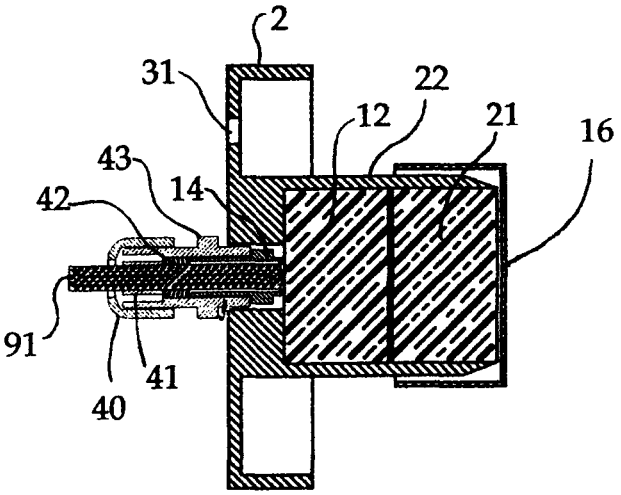

FIG. 9*e* is a cross-sectional view of the blasting cap holding assembly with the plastic explosive in the die cutter end cap.

FIG. 10*a* shows printed assembly instructions.

100. Clear plastic membrane
101. Printed text

FIG. 10*b* shows printed pictograph instructions on how to assemble instructions.

Figure 10C:
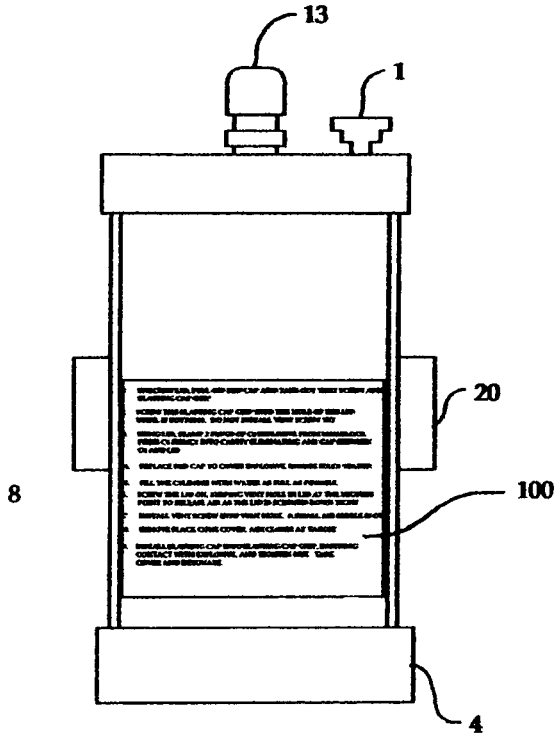

110. Printed pictograph instructions on clear membrane
111. Printed pictographs FIG. 10*c* is an exterior view of the instructions printed on a membrane and laminated onto the outer cylinder of the disruptor system.

Figure 10D:
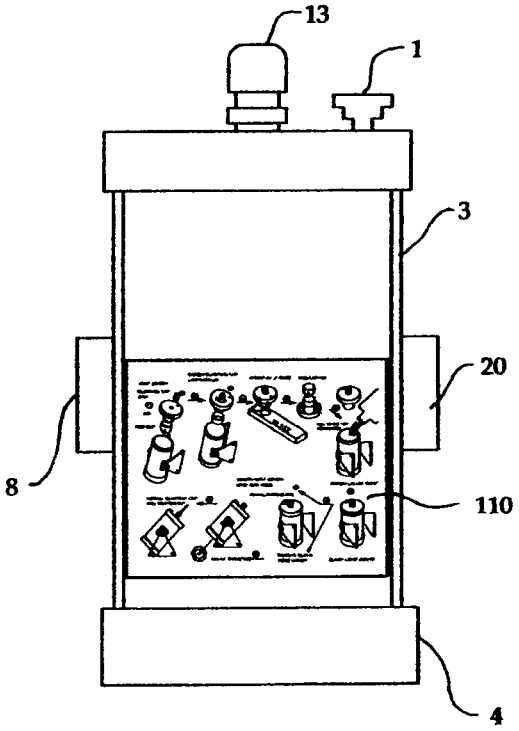

FIG. 10*d* is an exterior view of the pictograph instructions printed on a membrane and laminated onto the outer cylinder of the disruptor system.

Figure 11:
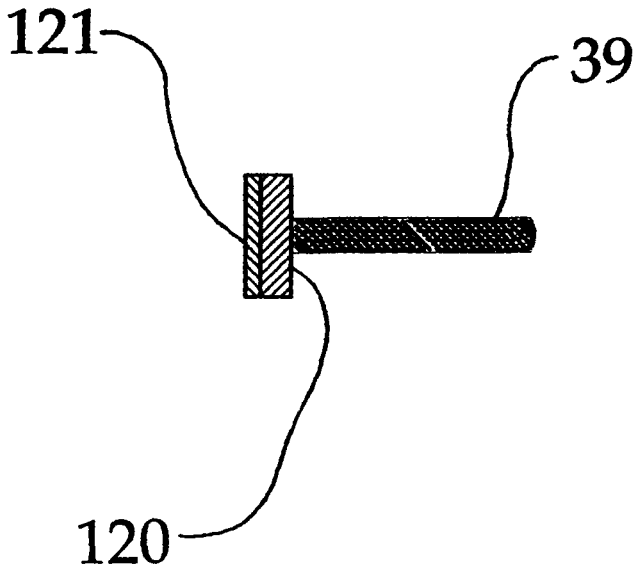

FIG. 11 shows the surrogate blasting cap cylinder and alignment mirror.

DETAILED DESCRIPTION OF THE PREFERRED EMBODIMENTS

Several typical embodiments of the invention are illustrated in the following frames. In these drawings several variations in assembly and arrangements will be shown.

In FIG. 1 a cross-sectional view of the disruptor assembly is shown. All the components shown in this diagram are typically made out of plastics, rubber, and water, except for the lasers 15, 18, to minimize the potential for spark generation and initiation of detonations. The disruptor consists of the components of a clear acrylic plastic, polycarbonate, polystyrene, or polyethylene terephthalate outer cylinder 3, polyethylene plastic end cap 4 with a vent hole and knurled nylon screw 1 ABS in plastic holding cap 2. On end of the cap 2 and on the centerline of the end cap 2 the assembly of the blasting cap clamp 13 and positioning sleeve 14 are screwed into the polyethylene end cap 2. Two cylinders of plastic explosive disks 12, 21 are shown contained by the cutting die 22 of the end cap 4. The plastic explosive (C-4) cylindrical discs 12, 21 are cut and fit snugly with coincident geometric centerlines (coaxial) against the blasting cap centering sleeve 14. A polyethylene cylindrical cap 16 less than a 1 mm thick is snugly placed over the plastic explosives 12, 21 and the cutting die 22. The forming cone 5 made of injection molded polyethylene with a wall thickness of 0.66 mm thick is formed to have a lip 23 to enable the forming cone 5 to center on the outer cylinder 3 and form a water tight seal compressed on an neoprene rubber O-ring 6. An end cap 4 of polyethylene plastic less than 1 mm thick and the outer cylinder 3 and the explosive holding cap 2 are machined to have matching threads to enable both caps 2,4, to screw onto the outer cylinder 3 and have coincident cylindrical centerlines (coaxial). The O-ring 6, and forming cone 5 are captured and compressed by screwing the end cap 4 onto the outer cylinder to form a water tight seal to the outer cylinder 3 and an air filled cavity between the forming cone 5 and the end cap 4.

The cavity between the forming cone 5 and the outer cylinder 3 is filled with water 9. The end cap 2 holding the plastic explosives 12, 21 and the blasting cap holder 13 and blasting cap sleeve 14 is screwed onto the outer cylinder 3 with the knurled vent screw 1 removed to allow displaced water and air to vent from the cavity between the forming cone 5 and outer cylinder 3. The vent screw is designed to relieve any air pockets within the water filled body. In recent tests data shows a substantial reduction in water jet formation and performance when air bubbles are present. When the closer is filled with a liquid and the lid is attached, the excess liquid overflows the body. When placed upright the vent screw is installed, thus eliminating any air pockets. Without this venting of excess water the displacement of water 9 during the assembly can pressurize the water 9 such that it can deform the thin walled shaping cone 5. Once the explosive holding cap 2 is screwed down to the desired position the vent screw 1 is replaced to contain the water in the disruptor. On the sides of the outer cylinder two blocks 8, of acrylic plastic are mounted and tapped with screw threads to form pivot mounts for the legs 10, 19. Triangular legs 10, 19 are mounted on the sides of the pivot mounts 8, 20 with two knurled screws 11, 24 to hold the triangular legs 19, 10 from the sides. By loosening and tightening the knurled pivot screws 11, 24 the user can adjust and fix the position of the triangular legs 10, 19 to position the centerline of the outer cylinder 3 and subsequent water jet.

The water jet will form and travel along the centerline of the forming cone 5 as the shock wave from the detonated the explosives 12, 21 is coupled into the water 9 and collapses on the cone cavity between cone 5 and cap 4. Objects or barriers will be struck by the subsequent water jet if they are placed on the projected centerline of the forming cone 5 in contact with the end cap 4 or up to 9 feet away. If the disruptor is placed in close proximity to the intended target the user can use their own spatial positioning skill to place the centerline of the forming cone over the target.

To align the centerline axis to an intended target that is further than direct contact or near contact the user can use this invention's laser fan alignment system. This system consists of two lasers 15, 18 equipped with a fan beam spreader. A fan beam spreader can be formed with a laser beam incident perpendicular to the axis of a glass cylinder or cylinders. The lasers are held by a ring 7 that fits over the end cap 4 such that the ring's 7 center axis is coaxial to that of the forming cone 5 and outer cylinder 3. The lasers 15, 18 are held in the ring 7 such that the planes of both fan beam planes intersect the projected centerline of the outer cylinder. The two lasers 15, 18 are positioned at ninety degrees on the holding ring 7 with respect to each other around the centerline axis of the outer cylinder 3, although different angular positions from ninety degrees about the centerline could be used for convenience. The two fan beams from the lasers 15, 18 so arranged will produce a light beam crossing pattern in front of the disruptor that defines the expected water jet strike point.

In FIG. 2 an exterior view of the water jet disruptor system on its side is shown. One of the two triangular feet 10 is visible and bolted with a knurled screw 11 to the side of the outer cylinder 3. The available holes in the triangular feet enable a variety of positions of the pivot screw 11. Legs have multiple holes 25, 26, 27, 28, 29 and can be easily adjusted for zero standoff or rotational to aim in any direction while resting stable on the ground or an object. Legs 10 can also be used for a specific standoff measurement for difference applications such as a general disruptor or penetrating a target from a distance. The inner holes 25, 26, 27 if used for the pivot point allow the end cap to be in proximity to a flat surface if the centerline of the outer cylinder 3 is parallel to the surface. If outer holes 28, 29 in the triangular 10 legs are used by the pivot screw 11, the outer cylinder 2 can be rotated about the pivot point resting on the triangular legs +135 −135 degrees (limited by the blasting caps and cable touching the planar support surface or the lasers 15). The holes 25, 26, 27, 28, 29 in the triangular legs 10 can provide mounting points to enable the system to be held in a mounting jig.

In FIG. 3 an exploded cross-sectional view of the disruptor components to be assembled is shown. The blasting cap clamp 13 is formed by modifying a commercially available cable clamp assembly from LAPPGROUP (29 Hanover Rd. Florham Park, N.J. 07932). This cable clamp assembly is modified to have a positioning sleeve 14 to enable the clamp to hold on the disruptor's centerline a variety of blasting cap sizes and an alignment rod and mirror. This cylindrical sleeve is machined out of Nylon. The cylindrical plastic explosives holding cap 2 is machined out of ABS plastic to form the threaded hole 32 on the centerline to fit the sleeve 14 and blasting cap holder 13. On the holding cap 2 out from the centerline and clear of the explosives cutting die 22 a hole 31 is drilled through and tapped for the vent screw 1. The holding cap 2 is tapped to have screw threads 35, 45 that mate with a coincident centerline with the screw threads 46, 47, 48, 49 of the outer cylinder 3. A die cutting cylindrical cavity 22 is machined on the end cap that is symmetrical about the centerline of the end cap. The outer cylinder 3 is tapped to have a thread 46, 47, 48, 49 that mates with the threads 35, 45, 55, 57 on the end cap 2 and end ring 4, and they have coincident centerlines (coaxial). A cylindrical explosives cover cap 16 is molded out of polyethylene plastic to fit snugly over the die cutting tube 22. A neoprene O-ring 6 is chosen to match the diameter of the outer cylinder 3 that has a flat sealing surfaced on the ends of the outer cylinder 3. The forming cone 5 is made out of polyethylene with a wall thickness of 0.66 mm and is coaxial to the outer cylinder 3. The forming cone 5 is made with a lip to provide a sealing surface for the O-ring gasket 6. If this disruptor system is to be used under water a plate could be used on the inside of the end cap 4 to insure a water tight seal between the forming cone 5 and the end ring 4.

The laser alignment ring 7 is shown to snugly fit onto the end cap 4. The two fan beam lasers 15, 18 are placed onto the alignment ring 7, and are aligned and glued in place. The side pivot blocks 8 are machined out of acrylic plastic and are chemically welded to the sides of the outer cylinder 3. These pivot blocks 8 have tapped holes 33 to accept the pivot screws. To make the alignment of the disruptor system orthogonal the placement of the pivot blocks 8 and tapped holes 33 are welded to the outer cylinder such that the axis of the tapped holes perpendicularly intersects the center line axis of the outer cylinder 3. Two triangular feet 10 are formed out of acrylic plastic with inside holes 25, 26, and 27 and outside holes 28, 29, 34 to enable two height positions and possible attachments to holding jigs.

In FIG. 4*a* a cross-sectional view of the first step of loading the plastic explosives into the holding cap is shown. The holding cap die cylinder 22 is positioned over a block of C-4 explosives 38 placed on a firm flat surface 58 to find and area of the explosive block where the cut will not result in a void in the cut cylinder of C-4. A void would result in an asymmetry in the resulting detonation, shock wave, and the explosive jet. The holding cap 2 has the threaded hole 37 that mates to the blasting cap holder. A vent hole 36 and hole for the blasting cap holder 37 are drilled and tapped in the holding cap 2.

In FIG. 4*b* the cross-sectional view of the holding cap 2 with the die cylinder 22 being pressed into the block of C-4 explosive 38 on top of the firm flat surface 58. The first cylinder 12 of plastic explosive is contained in the die of the holding cap 2. The tapped holes 37, 36 in the holding cap are left open.

In FIG. 4*c* a cross-sectional view of the holding cap 2 being removed from the C-4 explosive block 38 on the firm flat surface 58 is shown. A cylinder of C-4 explosive now is held within the die cylinder 22. The tapped holes 36, 37 in the holding cap 2 are left open.

In FIG. 4*d* a cross-sectional view of the holding cap 2 being repositioned over the block of plastic explosive 38 resting on the firm flat surface 58 to cut out a second cylinder of C-4 explosive. It is important to choose areas of the C-4 plastic explosive block far enough away from the first whole 59 cut in the C-4 explosive block such that the resulting second cut will not overlap the first cut. If there is an overlap this would result in a void in the explosive loaded in the cylinder 22 and an asymmetry in the resulting detonation and shock wave driving the explosive jet. The first cylinder of C-4 explosive 12 remains held within the cutting die cylinder 22. Both the tapped holes 36, 37 in the cap 2 are left open.

In FIG. 4*e* a cross-sectional view of the holding cap 2 with the die cylinder 22 being pressed into the block of C-4 explosive 38 resting on the firm flat surface 58. The second cylinder of plastic explosive 21 presses against the first cylinder of plastic explosive 12 which in turn presses up against the cap and may bulge into the open tapped hole 37 for the blasting cap. The tapped hole for the vent 36 in the holding cap 2 is left open.

In FIG. 4*f*. a cross-sectional view of the holding cap 2 being removed from the block of plastic explosive 38 is shown. The die cutting cylinder 22 now holds two cylinders 12, 21 of C-4 plastic explosive and these are tightly packed within the die cutting cylinder 22.

In FIG. 4*g*. a cross-sectional exploded view of the assembly of the blasting cap holder and the explosive holding cap is shown. In this assembly the blasting cap body 39, or (alternatively shown in FIG. 4*h* a surrogate alignment rod and mirror 120, 121) is inserted into the assembly of the commercially available cable clamp 40,41,42,43 and the machined centering sleeve 14. The blasting cap holder threaded body 43 and centering sleeve 14 can be positioned and screwed into the explosive holding cap 2 which is holding the two cylinders of plastic explosive 12, 21 within the die cutting cylinder 22. All the components: blasting cap 39, holder nut 40, cable clamp 41, 43, grommet 42, sleeve 14, cap 2, die cylinder 22, C-4 explosives 12, 21 and cover cap 16 are coaxial to each other. A polyethylene cover cap 16 is positioned to cover the end of the die cutting cylinder 21. The threaded vent hole 36 remains open.

In FIG. 4*h* a cross-sectional exploded view of the assembly of the surrogate blasting cap and alignment mirror clamped within the blasting cap holder is shown. As a safety precaution the assembly and alignment of the end cap 2 with explosives may be done without a viable blasting cap and the viable blasting cap is only inserted as the last step before firing. The cable clamp assembly has a rubber cylinder grommet 42 and contact fingers 41 such that when the clamp cap 40 is screwed down onto the threaded body 43 it will grip with gradually increased pressure on the blasting cap, surrogate alignment rod 39, 120 and mirror 121.

In FIG. 4*i* a cross-sectional view of the assembled plastic explosives holding lid, blasting cap, and the blasting cap holder is shown. The polyethylene cover cap 16 is placed over the end of the plastic explosive cylinder 21 and the cutting die 22. The sleeve 14 and the blasting cap 39 or surrogate 120 is pressed against the plastic explosive 12 to make an intimate contact point just at the surface of the plastic explosive and in the center of the plastic explosive cylinder 12 and on the centerline of the end cap 2. This step enables the plastic explosives 12, 21 to be formed to enable a repeatable positioning of the blasting cap 39 to the plastic explosives 12, 21. The clamping cap 44 can be unscrewed after this molding step and the blasting cap 39 or surrogate 120 can be removed to assemble and align the rest of the system without the blasting cap 39 or surrogate 120. The threaded vent hole 36 remains open.

In FIG. 5*a* a cross-sectional view of the assembled disruptor with a converging cone 51 and a flyer plate 50 is shown. In this particular configuration the explosive 12,21 is used to drive a flyer plate of copper 50 into a converging cone of material 51 such as polyethylene plastic or metal. The flyer plate concentrates reflected shock wave energy off the flyer plate edges back into the central region of the flyer plate 50 as it proceeds down the converging cone 51 to create a dense high energy projectile jet of copper traveling along the center line of the outer cylinder 3 and out of the disruptor through the O-ring seals 52, ring 4 and cover cap 7. The cover cap 7 may be made of a material and form a membrane less than 1 mm thick across the aperture of the end ring 4 such as polyethylene, Teflon, or copper that could line the penetration and effectively lubricate the penetration of the flyer projectile 50 through the target. The cover cap 7 may not need to have the O-ring or gas tight seal to the outer ring 4. But in some cases to insure a water tight seal between components, a glue sealant such as a two part epoxy or silicone rubber adhesive may be used to seal the surfaces of the end cap 7 and the ring 4, the explosive holding cap 2 to the outer cylinder 3 and the cone 51 and the die-cup explosive holder 22. Water is filled into the cavity between the end cap 7, outer cylinder 3, the explosive holding cap 2 and the forming cone 51. The vent screw 1 is screwed into the holding cap 2 after the disruptor has been assembled to seal the water in after venting air and excess water out of the chamber formed inside the outer cylinder 3, holding cap 2 and end cap 7. The rest of the assembly of components, O-ring 52, end ring 4, explosives 12,21, explosives cutter 22, blasting cap sleeve 14, blasting cap holder 13, leg pivots 8,20, leg pivot screws 11,24, triangular legs 10,19, end ring 4, and end cap 7 remain the same as the assembly shown in FIG. 1 and FIG. 2. As a note, to create a general disruptor without a jet, the forming cone 51 and the flyer plate 50 could be omitted, and an explosive cover cap 11 used.

In FIG. 5*b* a cross-sectional view the disruptor configured to drive a blade shaped forming cavity is shown. This blade forming cavity 56 can be formed by molding polyethylene or polystyrene in a mold, or formed by Solid Lithography Machine deposition. The blade forming cavity 56 cross-section is through the narrow width of the blade. This blade configuration is designed to create a planar jet that can be used to cut across cables and explosives. The forming cavity 56 is formed with 0.66 mm thickness on the wall of plastic to produce efficient jet forming. During the water 9 filing in the cavity between outer cylinder 3 and forming cone 56 it is important to vent the cavity by removing the vent screw 1 in the holder lid 2 to allow excess water 9 out in filling to avoid pressurizing the water and deforming the jet forming blade cone 56. Due to the asymmetric geometry of the blade 56 the pressurization of the water during assembly without venting would cause the blade to be asymmetrically deformed so it is more imperative in this example system to vent 1 the disruptor while being assembled. The rest of the assembly of components, end cap 4, explosives 12, 21, explosives cover 16, explosives cutter, 22 blasting cap sleeve 14, blasting cap holder 13, leg pivots 8, 20, leg pivot screws 11, 24, triangular legs 10, 19, O-ring 6, end ring 4, and laser alignment ring and cover cap 7 remain the same as the assembly shown in FIG. 1 and FIG. 2.

In FIG. 5*c* a cross-sectional view of the disruptor with a blade shaped jet forming cavity is shown. In this view the wider width of the blade 56 has been sectioned. One of the triangular legs 19 is seen by the side view with holes 25, 27, 28, 29. The rest of the assembly of components, holder cap 2 outer cylinder 3, end cap 4, O-ring 6, explosives 12, 21, explosive cover 16, explosives cutter 22, blasting cap sleeve 14, blasting cap holder 13, triangular leg 19, O-ring 6, cover cap 4, and laser alignment ring 7 remain the same as the assembly shown in FIG. 1 and FIG. 2.

In FIG. 6*a* a cross-sectional view of the disruptor with the fan of the alignment lasers is shown. In this configuration of the system the lasers 15, 18 are held in holes machined 90 degrees apart on the radius of the holder ring 7 that fits on the end cap 4 of the disruptor. The holder ring 7 has a coincident centerline to the centerline of the outer cylinder 3. The fan beams 60, 61 of the lasers 15,18 are formed by a beam laser striking glass or plastic cylinders and the resulting multiple reflections within the cylinder produces the fan beams. The two laser cylinders 15, 18 are rotated within the ring holder 7 holes to produce fan beams 60, 61 whose planes intersect the centerline of the outer cylinder. Once the fan beam lasers 15, 18 are aligned, they are locked in place with a two part epoxy applied between the holder 7 and the laser cylinders 15, 18. In this figure the fan beams 60,61 of the lasers 15, 18 are shown intersecting in front of the disruptor end ring 4 to form an "X" pattern on target 62 placed in front of the disruptor. The rest of the assembly of components, outer cylinder 3, holder cap 2, vent screw 1, water 9, end ring 4, explosives 12, 21, explosives cutter 22, explosives cover cap 16, blasting cap sleeve 14, blasting cap holder 13, leg pivot screw mounts 8, 20, leg pivot screws 11, 24 triangular legs 10, 19, O-ring 6, end ring 4, and laser alignment ring end cap 7 remain the same as the assembly shown in FIG. 1 and FIG. 2.

In FIG. 6*b* an exterior view of the disruptor rotated by ninety degrees around the centerline axis from FIG. 6*a* is shown. The intersections of the two fan laser beams 60, 61, from the lasers 15, 18 in front of the laser holding ring 7 on the centerline of the outer cylinder 3 are shown. In operation the disruptor is loaded with plastic explosives, water, and the holder cap 2 is screwed on and the vent screw 1 tightened. The outer cylinder 3 is then positioned with the triangular legs 10, 25, 26, 27, 28, 29, by loosening and tightening the pivot screws 11, to direct the crossing of the alignment beams 60, 61 onto the target 62. Once the disruptor is aligned the blasting caps are inserted into the holder 13, clamped, and then fired. When the explosively driven water jet disruptor system is used with the laser sight, it is capable of an accuracy of striking within ½ inch diameter at 9 feet. Once the system has been aimed, it is important to be gentle so that the system is not moved out of position. The design for the blasting cap grip makes it easy to install the blasting cap and secure (tighten) it with a gentle two finger twist so that laser is not moved off the target.

In FIG. 7*a* a cross-sectional view of the disruptor held by a robot is shown. The treaded robot has two independent tread drives that enable the robot to position the disruptor over an intended target. One of the two treads 73 is shown in this cross-sectional view. The particular configuration of the disruptor mounted on the chassis 75 of the robot and pointing down is one of many possible configurations that could be used. The disruptor could be mounted on a boom extending away from the treaded system of the robot and the triangular legs 10 can be bolted to the boom or to the robot through the available holes in the triangular legs 25, 27, 28, 29. The motor 71 and wheels 70, 72, of the robot are shown mounted on a frame. The tread 73 of the robot is shown. The robot is radio controlled and receives signals through an antenna 74. The rest of the assembly of components, outer cylinder 3, holder cap 2, vent screw 1, water 9, end ring 4, explosives 12, 21, explosives cutter 22, explosives cover cap 16, blasting cap sleeve 14, blasting cap holder 13, triangular leg 10, O-ring 6, remain the same as the assembly shown in FIG. 1 and FIG. 2.

In FIG. 7*b* the radio control for the robot is shown. Two toggle switches 82, 83 in the control box 81 can control forward, reverse, rotate clockwise, and rotate counter clockwise on the two tread motors. By sending radio signals through the antenna 80 to the robot's two tread motors, the robot can perform forward, reverse, rotate clockwise and rotate counter clockwise motions. These are the motions needed to position the disruptor over the target. The laser alignment systems can be used with the robot positioning to align the disruptor remotely.

In FIG. 8 a cross-sectional view of the disruptor shown with the gap between the tip of the jet forming cavity cone 5 and the end of the explosives cover cap 16. In this drawing a small bead 85 is shown inserted into the forming cone 5. This bead 85 of copper, steel, lead, or depleted uranium may be glued with cyanoacrylate glue to into the polyethylene cone 5. The bead can provide a small dense projectile that can increase the penetrating ability of the formed jet. We have found that from testing that a gap 86 of 1/16 of an inch between the end of the explosive cover cap 16 and the tip of the forming cone 5 provides repeatable and penetrating jets. When the cone 5 touches the explosive cover cap 16 less penetrating jets were formed and if the tip of the cone 5 was ¼ of an inch from the surface of the cover cap 16 less penetrating jets were formed. The design of explosively driven water jet disruptor is to have the tip of the plastic cone to be precisely 1/16" from the explosive. Recent tests show a substantial reduction in penetrating force when the cone is either too close or too far from the explosive. Recent tests show that with a 1/16 inch nominal gap between the cone tip and the explosive, explosively driven water jet will penetrate 1" mild steel. Recent tests/video/photography shows that when the system is assembled according to the instructions, the jet remains uniform and reliable for up to 9 feet. The water jet will dissipate after 35 feet from the end of the ring 4. Therefore it is important in the assembly that the gap between the tip of the polyethylene cone 5 that gap 86 is kept within 1/16 inch and ⅛ of an inch from the surface of the explosive cover cap 16. The edges of the leg mounts 20, 8 can be used as sighting references. The outer cylinder 3, leg mounts 8, 20, and triangular legs 10, 19 are all made out of clear acrylic plastic. Thus it is easy to sight through clear water when it is loaded and the outer cylinder 1, leg mounts, 8, 20 and legs 10, 19 to check that this gap 86 is maintained. The rest of the assembly of components; outer cylinder 3, O-ring 6, end ring 4, explosives 12,21, explosives cutter 22, explosives cap 16, vent screw 1, blasting cap sleeve 14, blasting cap holder 13, leg pivots 8, 20, leg pivot screws 11,24, triangular legs 10,19, O-ring 6, and cover cap 2, are the same as in FIG. 1.

In FIG. 9*a* a cross-sectional exploded view of the blasting cap holder and blasting cap is shown. In this particular illustration the acceptance of the large diameter blasting cap 90 is shown. A surrogate alignment cylinder 90 may be substituted for the blasting cap which has a diameter of the largest blasting cap that can be used with the holder sleeve 14. The sleeve 14 is formed to be a slip fit over the largest diameter blasting cap 90 that will be used with the disruptor. The end of the sleeve 14 has a ledge 92 at the end of the sleeve to stop the blasting cap 90 from going through the sleeve 14 and to position the plastic explosives at the end of the sleeve 14. Around the blasting cap sleeve 14 a cylindrical threaded body 43 of the of the cable clamp will rest on the shoulder 93 of the blasting cap sleeve 14. The cable clamp 43 has slitted fingers 41 and a rubber grommet 42. A threaded cap 40 mates to the end of the cable clamp 43. The large diameter blasting cap 90 is shown outside of the threaded cap 40.

In FIG. 9*b* a cross-sectional assembled view of the blasting cap holder and blasting cap are shown. The blasting cap sleeve 14 is inserted into the cable clamp holder 43. In this particular example the large diameter blasting cap 90 is inserted into the sleeve 14 though the cable clamp nut 40, fingers 41, rubber grommet 42 and cable clamp 43. The cable clamp nut 40 is tightened down on the assembly 14,43,42,41. The nut tightening causes the fingers 41 of the cable clamp 43 to symmetrically press the blasting cap cylinder 90.

In FIG. 9*c* a cross-sectional exploded view of the blasting cap holder and blasting cap is shown. In this particular example the smaller diameter blasting cap 91 is being held by the holder 43. The sleeve is formed to be a slip fit over the largest diameter blasting cap that will be used with the disruptor. At the end of the sleeve 14 there is a ledge 92, to stop the blasting cap from going through the sleeve and position the plastic explosives at the end of the sleeve 14. Around the blasting cap sleeve is a cylindrical threaded body 43 of the of the cable clamp 43 that will rest on the shoulder of the blasting cap sleeve 93. The cable clamp has slitted fingers 41 and a rubber grommet 42. A threaded cap 40 mates to the end of the cable clamp 43. The small diameter blasting cap 91 is shown outside of the threaded cap 40.

In FIG. 9*d* a cross-sectional assembled view of the blasting cap and holder are shown. The blasting cap sleeve 14 is inserted into the cable clamp holder 43. In this particular example the small diameter blasting cap 91 is inserted into the sleeve 14, through the cable clamp nut 40, fingers 41, grommet 42 holders 43, and the cable clamp nut 40 is tightened down on the assembly. The nut tightening causes the fingers 41 of the cable clamp 43 to symmetrically press the blasting cap cylinder 91.

In FIG. 9*e* a cross-sectional assembled view of the blasting cap holder with the blasting cap screwed into the plastic explosives holding cap is shown. In this illustration the blasting cap sleeve 14 is captured between the plastic explosives 12, 21 and the cable clamp holder 43, 42, 40 by the blasting cap sleeve 14 resting on the end of the cable clamp holder 43. As the cable clamp holder 43 is screwed into lid 2, with die cup cylinder 22 and cup end cap 16, the sleeve 14 and blasting cap 91 are pressed into the plastic explosive 12, 21. After this step of tightening the cable clamp holder 43 to the lid 2 with the plastic explosives holding cup 22 the threaded cable clamp cap 40 can be partially unscrewed, which releases the pressure and contact of the fingers 41, and grommet 42 on the blasting cap cylinder 91. This allows the blasting cap 91 to be removed from the cable clamp 43 and the next step of assembling the disruptor done without a blasting cap or surrogate alignment cylinder 91. The vent hole 31 in the end cap 2 is left open.

In FIG. 10*a* the assembly instructions printed on a clear plastic polyester membrane are shown. This printed plastic membrane 100 can be imbued with a contact adhesive and after the printing 101 is done can be pressed onto the outer cylinder 3. By printing with dark water proof ink 101 on a clear membrane enables the user to see through the instructions and view the water and bubbles inside the cylinder 3 of the disruptor. The printed instructions 101 are organized by numbered sequential steps that must be performed to assemble and utilize the disruptor. These instructions 100 may be translated and printed in different languages of the user.

In FIG. 10*b* the assembly instructions in pictograph form on a clear plastic polyester membrane is shown. The printed plastic membrane 110 can have a contact adhesive and pressed onto the outer cylinder 3. The printed pictographs 111 have ascending numbered illustrations that need to be performed to operate the disruptor. The pictographs 111 are printed in water proof dark ink to provide clear viewing.

In FIG. 10*c* a view of the assembled disruptor is shown with the written instructions laminated to the side. The written instructions can be placed on the side of the outer cylinder such that they are not obscured by the leg pivots or the triangular legs. The instruction membrane is placed on the side of the outer cylinder between the leg mounts 8, 20 and the end caps 2, and end ring 4. Preferably the instructions are placed toward the end ring 4 portion of the outer cylinder 3 to enable a clear view of the gap between plastic explosives and the forming cone inside the outer cylinder 3. The other components shown in this example are the blasting cap holder 13 vent screw 1.

In FIG. 10*d* a view of the assembled disruptor with the pictograph instructions are shown. The pictographs are placed on the opposite side of the text of the outer cylinder. The pictograph membrane 110 is placed on the side of the outer cylinder 3 between the leg mounts 8, and the end ring 4. Preferably the instructions are placed toward the end ring 4 end of the outer cylinder 3 to enable a clear view of the gap between plastic explosives and the forming cone inside the outer cylinder 3. The other components shown in this example are the blasting cap holder 13 vent screw 1.

In FIG. 11 the surrogate blasting cap cylinder and alignment reflector are shown. The cylinder 120 is formed to be a tight slip fit into the holder sleeve. It also should match the dimensions of the portion of the largest blasting caps that will be used with the disruptor. Thus it aligns to the blasting cap sleeve. A mirror or mirror finish machined surface 121 is formed on the end on the end of the surrogate cylinder to be perpendicular to the axis of the surrogate blasting cap cylinder 120. A cross mark or concentric circle marks may be placed on the reflector 121 to enable the optical alignment to visually see the centerline point on the back of the disruptor. In operation a line of sight can be defined by a telescope, gun scope, or laser beam pointing at the intended target to be disrupted. The disruptor is then placed and positioned with triangular legs, robot, or holding scheme on that line of sight such that the center of the disruptor is on the line of sight at a reflected image or beam reflects back into the telescope, gun scope or laser beam. Once alignment is done, the surrogate blasting cap is then removed and the blasting cap with cables is inserted and tightened gently without disturbing the alignment. The blast area is cleared and the blasting cap is fired with an electrical pulse. This blasting cap detonates the plastic explosive and the subsequent shock wave travels into the water, collapsing a shock wave onto the forming cavity. This shock wave collapse on the forming cavity results in a concentrated energy jet of water and/or entrained material to eject a supersonic jet that can penetrate and disrupt the target objects on the center line of the disruptor without spark generation. Other materials and shaped forming cavities can be devised and used with this precision cylindrical coaxial disruptor system that we have described. They can result in the shock wave energy delivery or material projectiles as desired by the user.

While the invention has been described with reference to specific embodiments, modifications and variations of the invention may be constructed without departing from the scope of the invention, which is defined in the following claims.

We claim:

1. Apparatus comprising an explosively driven water jet delivery structure, further comprising a cylinder having first and second opposite ends, a lid with a die cup connected to the first end, and a ring connected to the second end, and the following coaxially arranged components: a blasting cap holder mounted coaxially in the lid, a sleeve within the holder, a cone ledge at an inner end of the sleeve, a, clamping ferrule at an outer end of the holder, and a rubber ring within the holder; the holder being coaxially mounted on the lid, the die cup being on an inner side of the lid, the die cup adapted to cut and hold plastic explosive against the lid, the lid being mounted and sealed on the first end of the cylinder, the ring being mounted and sealed on the second end of the cylinder, a gas filled shock cavity former arranged inside of the cylinder between the die cup and the ring, and a remaining void between the cylinder, the lid, the die cup and the gas filled shock cavity former adapted to be filled with a liquid or material that liquefies when shocked, and a non-coaxial fluid vent hole in the lid, and the vent hole being sealed with a screw.

2. The apparatus of claim 1, wherein the shock cavity former is a cone sealed to the second end of cylinder and the cone is the shock cavity former.

3. The apparatus of claim 1, wherein the gas filled shock cavity former is spaced from the die cup on the lid.

4. The apparatus of claim 1, further comprising a cap placed over the plastic explosives and the die cup.

5. The apparatus of claim 4, wherein the cavity former is a cone having a tip and having a cone axis coincident to an axis of the cylinder and the tip of the cone has a 1/16 inch-1/32+1/16 inch gap between tip of cone and the cap on the explosive and the die cup.

6. The apparatus of claim 4, wherein the shock cavity former is a cone, and an explosive cover cap and the die cup and explosive cap does not touch shock former cone, further comprising an end cover over the second end of the cylinder, two non-coaxial blocks with threaded holes attached opposite each other and perpendicular to the surface of the cylinder, two non-coaxial triangular plates with holes in corners are attached to the blocks through plate attachment screws, two non-coaxial fan-beams sources of light are affixed to the cylinder to project light rays plane perpendicular to the surface of the cylinder and intersecting an extended axis of the cylinder, instructions of assembly and use are affixed to the cylinder with words and pictographs, and a surrogate blasting cap cylinder that fits within the blasting cap sleeve instead of the blasting cap with a light reflector on the end that is perpendicular to a centerline of the surrogate blasting cap, the surrogate blasting cap cylinder adapted to position and shape plastic explosives and to optically align the apparatus.

7. The apparatus of claim 1, further comprising a plate placed on the plastic explosive.

8. The apparatus of claim 7, wherein the plate is made of copper, steel, Teflon, lead, tungsten, uranium, bismuth or a combination thereof.

9. The apparatus of claim 1, further comprising a cover placed over the ring.

10. The apparatus of claim 9, further comprising sealing gaskets placed between the ring, the cylinder and the cover.

11. The apparatus of claim 1, further comprising two non-coaxial blocks with threaded holes attached opposite each other and perpendicular to the surface of the cylinder, and two non-coaxial triangular plates with holes in corners attached to the blocks through screws.

12. The apparatus of claim 11, further comprising two threaded holes in the blocks, which threaded holes are opposite to each other and perpendicular to the surface of the cylinder, two triangular plates with holes in corners, two leg attachment screws extended through the holes in the plates and threaded into the two threaded holes in the blocks to align and secure the triangular plates to the outer cylinder.

13. The apparatus of claim 12, wherein the cylinder is transparent and is made of acrylic, polycarbonate, polystyrene, or polyethylene terephthalate plastic, the lid and the die cup are made of ABS plastic, the blasting cap sleeve is made out of Nylon plastic, the void filling material is water, the shock cavity former is polyethylene plastic about 1 mm or less in thickness, the explosive and die cup cap is made of polyethylene less than 1 mm thick, a cover over the second end of the cylinder is made of less than 1 mm thick polyethylene plastic, the vent screw and leg pivot screws made of Nylon plastic and the triangular plates are made of acrylic plastic.

14. The apparatus of claim 1, wherein the cavity former further comprises a diverging or converging cone with a lip that fits on the cylinder with an O-ring seal, and instructions of assembly and use affixed to the side of the cylinder with words and pictographs.

15. The apparatus of claim 1, further comprising a surrogate blasting cap that fits within the blasting cap sleeve instead of a blasting cap, the surrogate blasting cap having perpendicular to a centerline light reflector surface for optical alignment of the apparatus, and wherein the clamping ferrule has slit fingers and rubber ring coaxial with the cylinder, and wherein the blasting cap holder is mounted to be flush with an interior surface of the lid and a lid side of the die cup.

16. The apparatus of claim 1, wherein two fan-beams of light are attached to the cylinder and are adapted to define a plane perpendicular to the surface of the outer cylinder and on an extended axis of the cylinder to define a center line projection of the cylinder center line axis at an intersection of these two fan-beams.

17. The apparatus of claim 1, further comprising an end cap cover over the second end of the outer cylinder.

18. The apparatus of claim 1, further comprising marks placed on the cylinder adapted to enable the user by sighting through the outer cylinder to sight a correct or incorrect distance between the tip of the inner cone and the cap on the die cap and the explosive.

19. The apparatus of claim 1, where in the cylinder is mounted on a radio controlled remote robot to be transported and positioned.

20. Apparatus comprising an explosively driven water jet delivery, further comprising a cylinder having first and second opposite ends, a lid with a die cup connected to the first end, and a ring and barrier connected to the second end, and the following coaxially arranged components being mounted on the lid: a blasting cap holder with a sleeve, a clamping ferrule and a rubber ring, and an inward cone ledge at an inner end of the sleeve; the die cup being mounted on an inside of the lid opposite to and in communication with the blasting cap holder, the die cup being configured to cut and hold plastic explosive on the lid, the lid being mounted and sealed on the first end of the cylinder, the cylinder being sealed at the second end of the cylinder with the ring and the barrier, a gas filled shock cavity former arranged inside the cylinder between the die cup with the plastic explosive and the ring, wherein a remaining void between the cylinder, the lid, the die cup with the explosive, and the gas filled shock forming cavity is filled with a fluid or material that liquefies when shocked, further comprising two non-coaxial fan-beam sources of light affixed to the cylinder to project light rays to a plane perpendicular to the surface of the cylinder and intersecting an extended imaginary axis of the cylinder.

21. The apparatus of claim 20, further comprising a cap over the explosive, and wherein a gas filled shock forming cavity has a cone tip no less than 1/32 of an inch separation between the cap and the cone shaped cavity, and wherein the separation is no greater than 1/8 inch, wherein the remaining void between the cylinder, lid, explosive, and the gas filled shock forming cavity is filled with the fluid or the material that liquefies when shocked.

22. The apparatus of claim 20, wherein the threaded holes in the blocks and the vent hole have same diameters and thread pitch and the leg attachment screws and the screw plug have knurled heads and are identical are used interchangeably.

* * * * *